US012280302B2

(12) United States Patent
Kaindl

(10) Patent No.: US 12,280,302 B2
(45) Date of Patent: Apr. 22, 2025

(54) GOLF ACCESSORY PLATFORM

(71) Applicant: Robert Kaindl, Redmond, WA (US)

(72) Inventor: Robert Kaindl, Redmond, WA (US)

( * ) Notice: Subject to any disclaimer, the term of this patent is extended or adjusted under 35 U.S.C. 154(b) by 9 days.

(21) Appl. No.: 17/841,537

(22) Filed: Jun. 15, 2022

(65) Prior Publication Data

US 2023/0141472 A1 May 11, 2023

Related U.S. Application Data

(60) Provisional application No. 63/278,466, filed on Nov. 11, 2021.

(51) Int. Cl.
*A63B 55/00* (2015.01)
*A63B 55/60* (2015.01)

(52) U.S. Cl.
CPC ..... *A63B 55/408* (2015.10); *A63B 55/60* (2015.10); *A63B 2055/602* (2015.10)

(58) Field of Classification Search
CPC .. A63B 55/408; A63B 55/60; A63B 2055/602
USPC ..... 206/279
See application file for complete search history.

(56) References Cited

U.S. PATENT DOCUMENTS

2013/0105341 A1* 5/2013 Whitworth ..... A63B 55/408 206/315.6
2017/0361181 A1* 12/2017 LaMar ..... A63B 55/404
2020/0353329 A1* 11/2020 Martell ..... A63B 55/40

* cited by examiner

*Primary Examiner* — Don M Anderson
*Assistant Examiner* — Jessica Kavini Tamil
(74) *Attorney, Agent, or Firm* — Seattle Partent Group PLLC; James Haugen

(57) ABSTRACT

Disclosed, among other things, are a golf accessory platform and example golf accessories, offering functionality of holding headcovers, gloves, hats, or other items while on and off of a course, offering protection when clubs are being transported or in play, being used as a training device such as an alignment rod, training for increasing swing speeds, storing alignment rods, sticks, or other golf accessories. It may also allow swing tracking practice, provide a way to protect oneself, and provides a prominent space for advertising or branding opportunities.

3 Claims, 26 Drawing Sheets

Platform
100

Platform
200

Platform
100

Platform
700

GOLF ACCESSORY PLATFORM

FIELD

This disclosure relates generally to a golf accessory platform and accessories.

BACKGROUND

Golfers presently don't have an effective way to properly secure golf equipment from getting damaged while transported as baggage on commercial flights or shipped or stored. During a round of golf, there are times that a golfer may wish to remove their gloves, hat, or headcover from a club they are using. There is usually no convenient place to place these items, often resulting in these items becoming lost.

SUMMARY

The following presents a simplified summary of the disclosure to provide a basic understanding to the reader. This summary is not an extensive overview of the disclosure, nor does it identify key or critical elements of the claimed subject matter or define its scope. Its sole purpose is to present some concepts disclosed in a simplified form as a precursor to the more detailed description that is later presented.

A golf equipment platform may benefit golfers as an alignment tool for better putting while on the practice putting green or practicing shots while on the driving range, or as a speed wing training tool that may increase a golfer's skills by increasing proficiencies and confidence. Golfers may be able to increase skills and bring practiced swings onto the golf course for better player game performance brought from the practice areas. Additionally, a golfer may be interested in protecting and securing golf accessories such as alignment rods or speed training sticks by housing these items within a structure or a rigid apparatus. Furthermore, a golfer may want to protect golf items from weather conditions such as rain or heavy stormy winds.

Disclosed is a platform that may allow storage of gloves, hats, headcovers, or other golf accessories, while also helping protect golf clubs when traveling or while in play. Additionally, it may be used as a golf training device such as an alignment rod or to support, protect, and hold or house alignment rods and swing training sticks.

The platform may have a handle, which may be comparable in size to a golf club shaft, allowing the platform to be conveniently kept in a golf bag. The handle may be straight, which may allow it to be used as an alignment rod or a speed swing training tool.

A top portion of the platform may be wider to provide support for holding, for example, a glove, hat, or headcover. The platform may be longer than a golf club, which may allow it to rise above the golf clubs when in a bag, which may provide protection for the clubs when they are being transported or while in play.

Additionally, various accessories may be attached to the platform, which may aid with swing training, alignment, or additional protection against damage or weather conditions.

BRIEF DESCRIPTION OF THE DRAWINGS

The present description may be better understood from the following detailed description read in light of the appended drawings, wherein.

DETAILED DESCRIPTION

Figure 1:
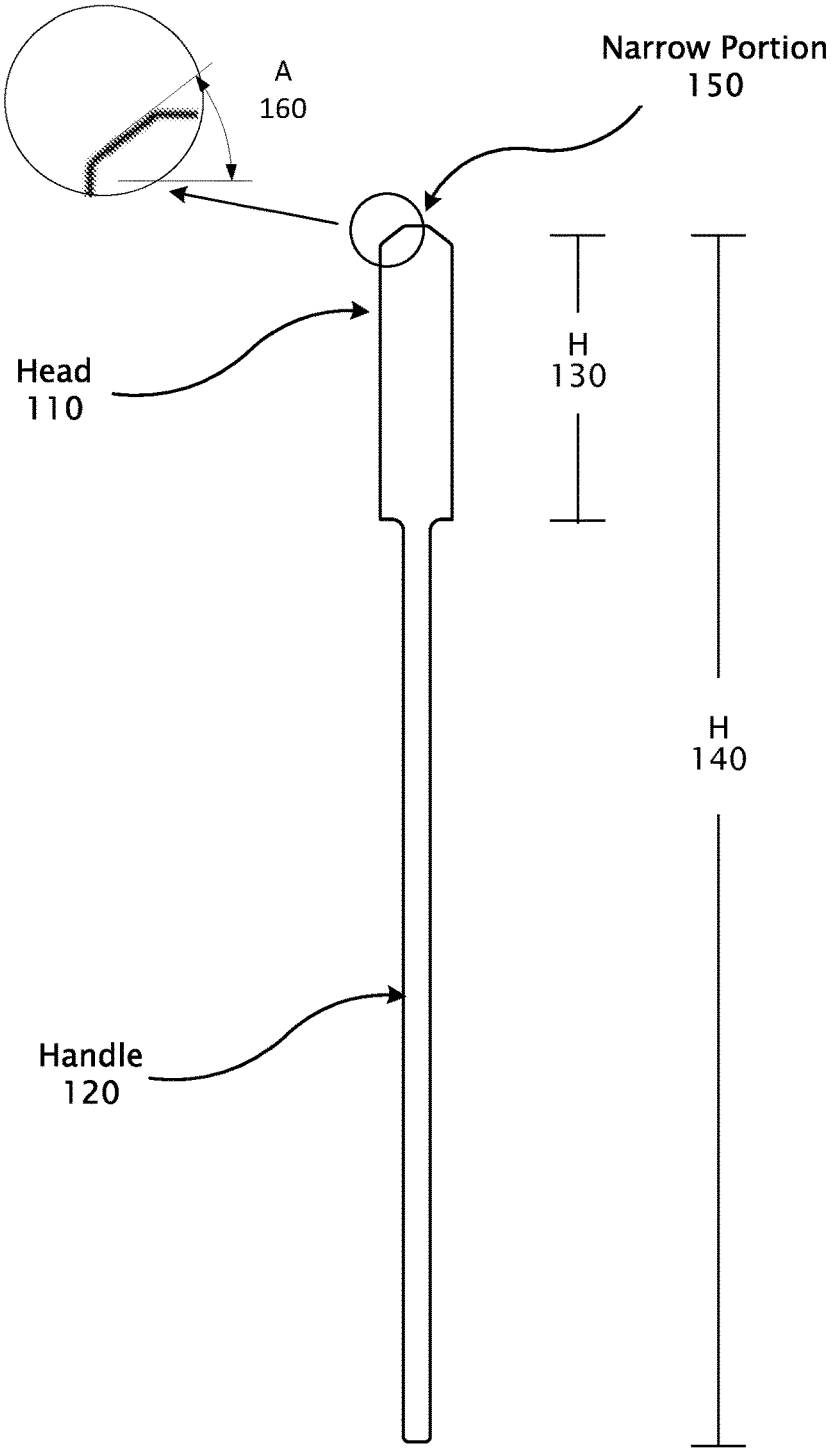
FIG. 1 is a diagram illustrating a platform, according to one implementation.

A more particular description of certain implementations of a platform may be had by references to the implementations shown in the drawings that form a part of this specification, in which like numerals represent like objects.

FIG. 1 is a diagram illustrating Platform 100, according to one implementation. While making a shot, a headcover may need to be removed from a club. For example, Head 110 may be used to hold a headcover, which may help prevent losing the headcover. Head 110 may also be used to hold a hat or a glove, for example, to allow them to air out or dry.

Platform 100 may help organize a golfer while improving player confidence. It may provide a repeatable and simple solution to safely store golf equipment from becoming misplaced. It may also help keep golf equipment protected, undamaged, and safe while being shipped as baggage, in transit, or in play. Platform 100 may help organize a golfer to protect against losing equipment that is consistently lost or misplaced by providing a simple short-term solution to store easy-to-lose or misplace golf equipment, for example, head covers, hats, or gloves. Platform 100 is designed to extend above and around golf equipment while within the golf bag during play or while being transported within a golf travel bag. This shield system may be inflatable, rigid plastic, metal, or a combination thereof. The golf shield accessory may slide onto, over, or around the top of the golf storage stick with the use of the connectable protective Cap 720. The two basic golf travel bag equipment protection functions of this platform are 1) a wrap-around independent floating protection platform version and 2) a slide over or attached to the top of the equipment storage stick device for protection from proximity impact threats.

Handle 120 may allow Platform 100 to be placed in a golf bag at a protective height with clubs while still being easily accessible. Alternatively, Platform 100 may be, for example, placed in a golf bag pocket, attached to a pull cart, attached to a power cart, carried, or attached to a golfer. Platform 100 may have a fastening means, which may allow it to be removably or permanently attached to a golf bag. Platform 100 may also be stuck into the ground on a golf course. One having skill in the art will recognize that there are many ways to use or carry Platform 100.

Platform 100 may also be used to defend against an attack, for example, from an animal on a golf course, either by scaring or striking the animal.

One having skill in the art will also recognize that Platform 100 may be made of different materials or combinations of materials, including, for example, plastic, fiberglass, wood, metal, carbon fiber, or other materials.

Head 110 may have Height 130, ranging from approximately 11" to 15", and be about 1" to 5" wide, while the overall height of Platform 100 may range from approximately 48" to 52". Head 110 may transition to Narrow Portion 150, with Angle A 160 ranging approximately 20° to 55° from the horizontal. Height 140 may be approximately 40" to 60". Handle 120 may have a width of 0.5" to 2".

Figure 2:
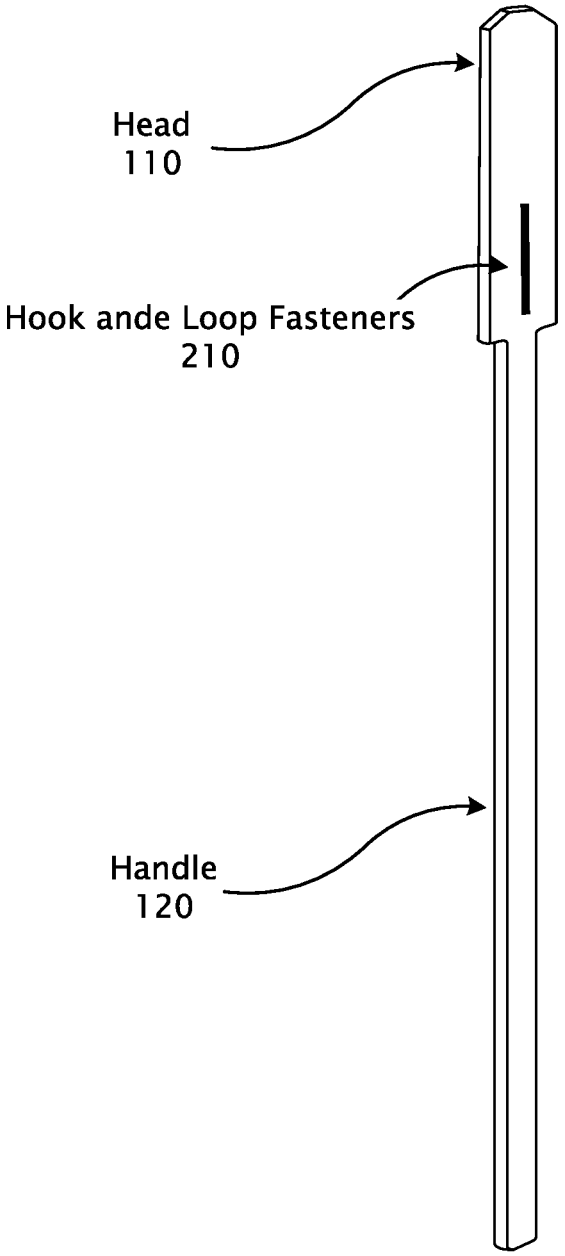
FIG. 2 is a diagram illustrating a platform, according to another implementation.

FIG. 2 is a diagram illustrating Platform 200, according to one implementation. Platform 200 may have Hook and Loop Fasteners 210 attached to Head 110, which may be used, for example, to hold a glove, while Head 110 is also operable to hold a hat or headcover on a top or side.

Figure 3:
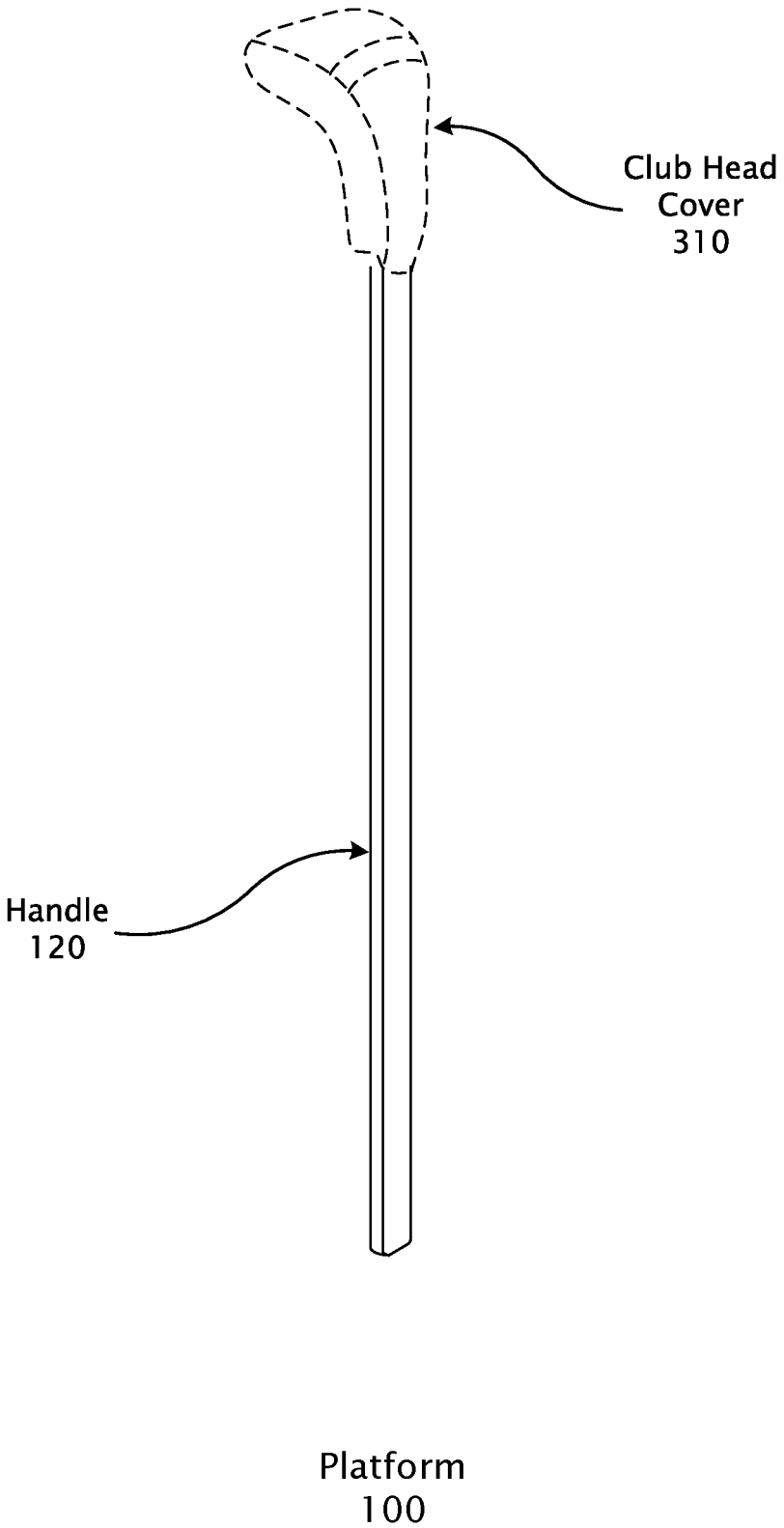
FIG. 3 is a diagram illustrating a platform with a club head cover, according to one implementation.

FIG. 3 is a diagram illustrating Platform 100. In this example, Platform 200 is holding Club Head Cover 310. Platform 100 may help prevent losing club head covers by providing a safe place to hold them while a corresponding club is being used while simultaneously protecting surrounding golf clubs and equipment.

Figure 4:
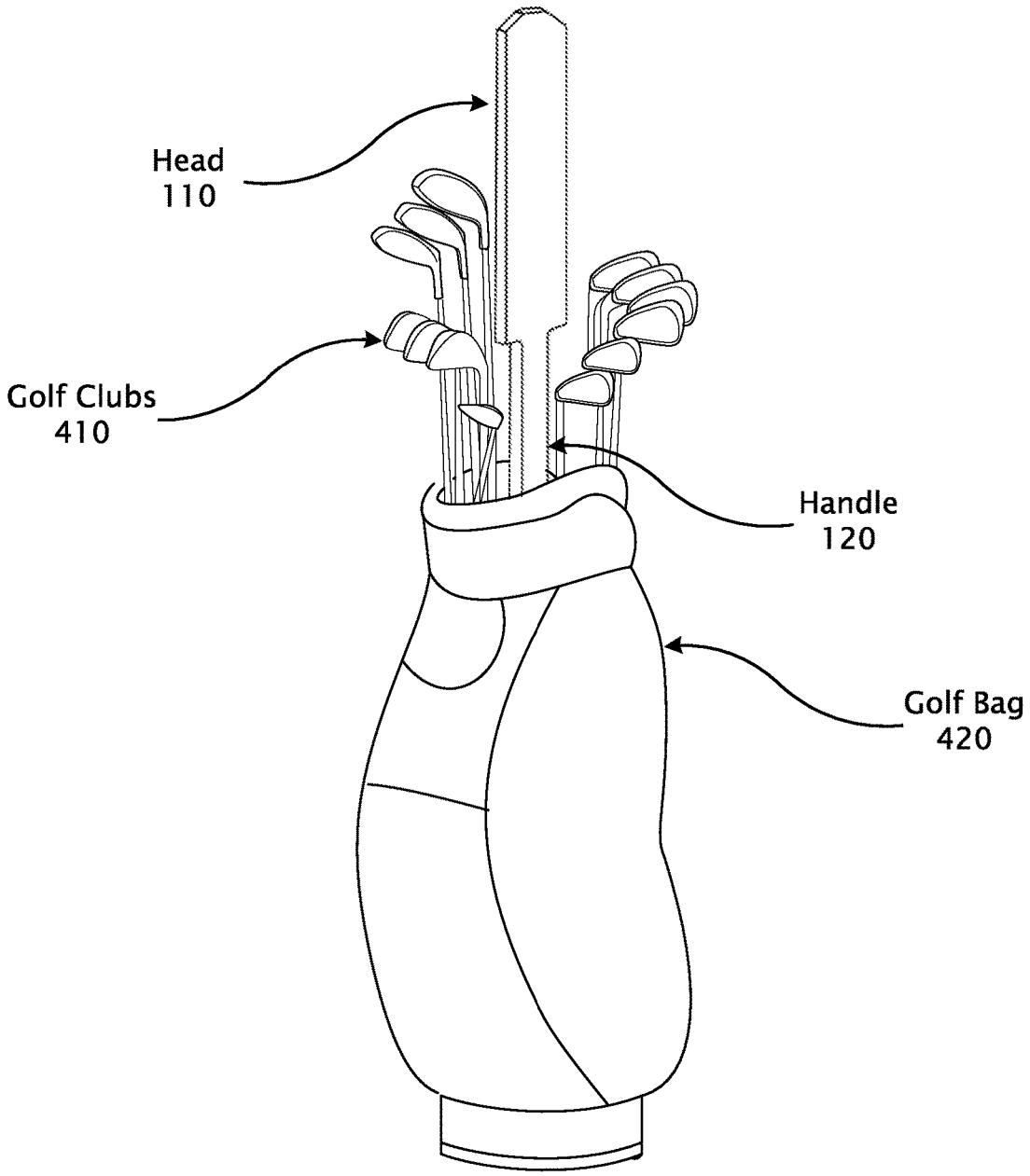
FIG. 4 is a diagram illustrating a platform in a bag of clubs, according to one implementation.

FIG. 4 is a diagram illustrating Platform 100 in Golf Bag 420. Platform 100 may fit comfortably within or alongside Golf Bag 420. Handle 120 may be approximately the same size as a golf club shaft. Platform 100 may provide a golfer with a simple solution to help keep equipment organized and safe.

Platform 100 may be placed within Golf Bag 420 through the top of the opening where Golf Clubs 410 are located. Platform 100 may be taller in elevation than all other items within the golf bag, which may help protect Golf Clubs 410 within Golf Bag 420 from damage while in transit or in play.

Figure 5:
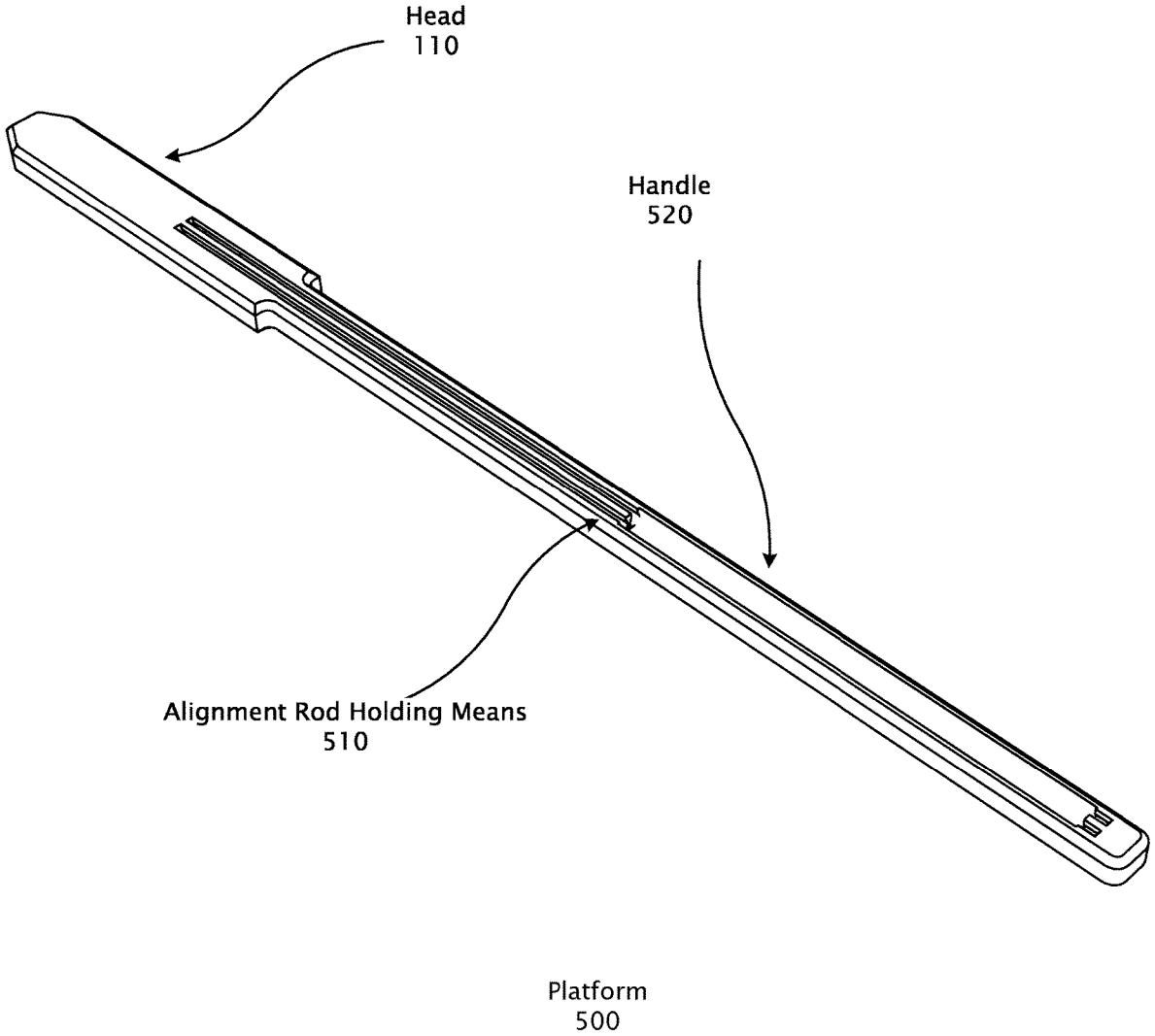
FIG. 5 is a diagram illustrating a platform, according to another implementation.

FIG. 5 is a diagram illustrating Platform 500. Platform 500 may have Alignment Rod Holding Means 510 to store one or more alignment rods within Handle 520. Alignment rods may be alignment rods, alignment sticks, training sticks, or speed sticks.

For example, Alignment Rod Holding Means 510 may be grooves in Handle 520 into which alignment rods may snap. Alternatively, hook and loop straps may be used to hold alignment rods in Handle 520. In another implementation, hook and loop fasteners may be attached to Handle 520 and alignment rods. In yet another implementation, Handle 520 may have a groove with one or more holes at the bottom into which alignment rods can slide.

Figure 6:
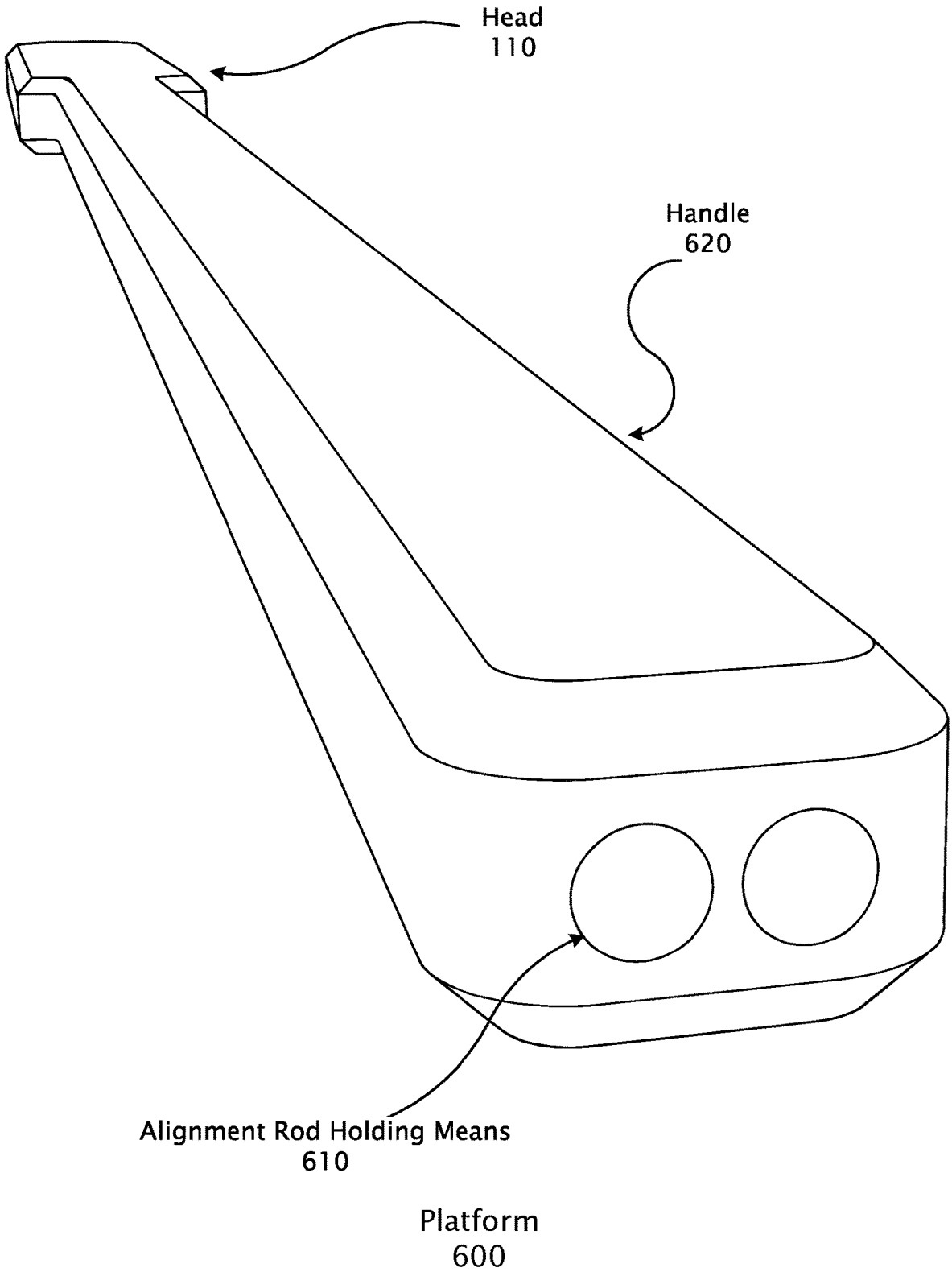
FIG. 6 is a diagram illustrating a platform, according to another implementation.

FIG. 6 is a diagram illustrating Platform 600, according to one implementation. Handle 620 may have a hole through the bottom with a Holding Means 610, friction, hook and loop fasteners, or snaps, for example, which may hold an alignment rod when slid inside Handle 620. One having skill in the art will recognize that many different ways may be used to hold alignment rods to Handle 520 or 620.

Figure 7:
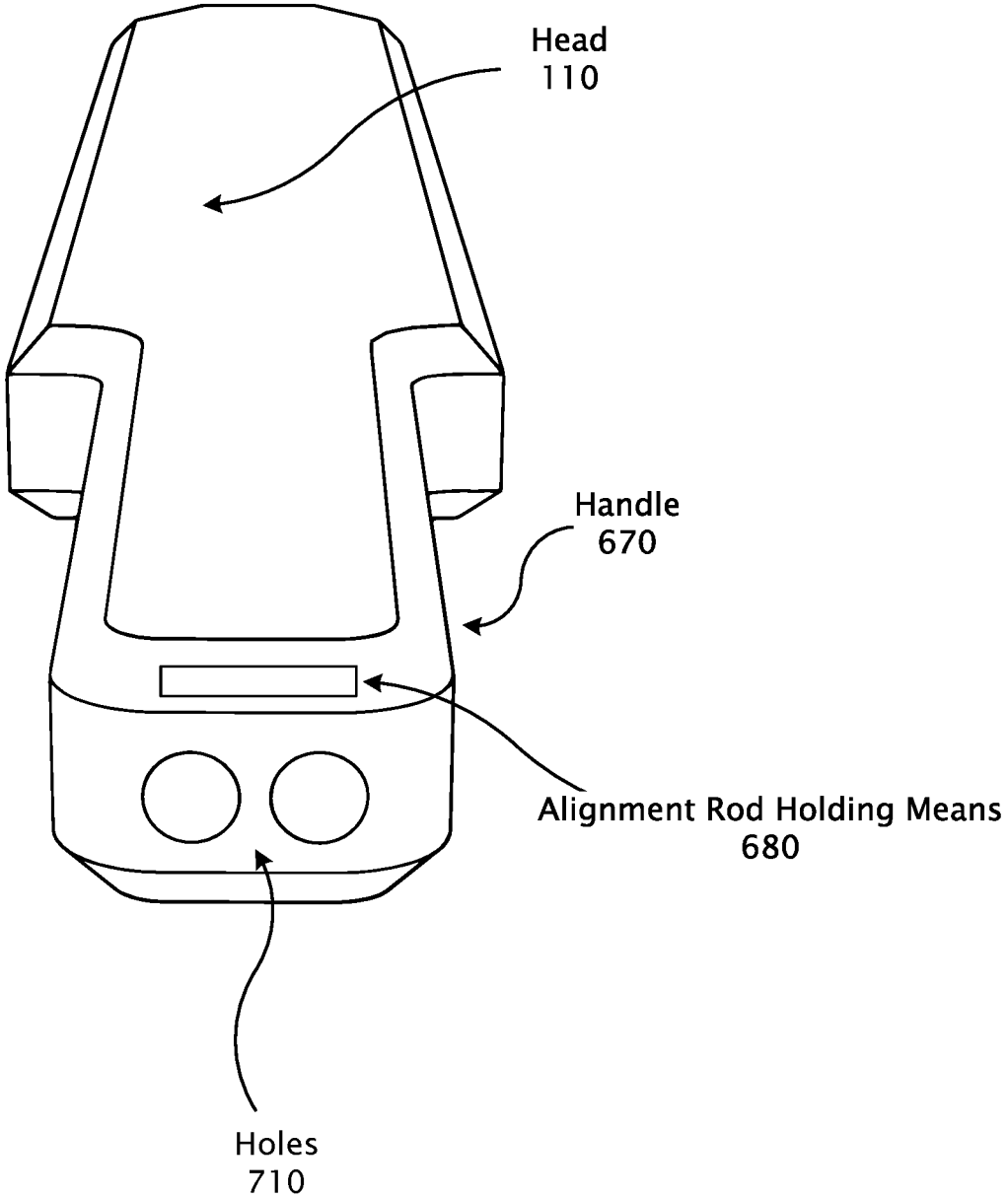
FIG. 7 is a diagram illustrating a platform, according to another implementation.

FIG. 7 is a diagram illustrating Platform 700, according to one implementation. Handle 670 may have Holes 710 with a Holding Means 680, friction, hook and loop fasteners, clamps, or snaps, for example, that may hold an alignment rod when slid inside Handle 670. Platform 700 may be placed into a cup holder or some other shallow holder when Platform 700 is not being used to house alignment rods within Platform 700 in a golf bag or stored.

Platform 700 may be shorter than Platform 600, which may allow an alignment rod to extend past a bottom of Handle 670. One having skill in the art will recognize that many different ways may be used to hold alignment rods to Handle 670. Platform 700 may be used in a golf bag during play in order to secure or separate alignment rods or speed sticks from being damaged or rubbing against each other. Handle 670 provides a shorter version of Platform 100 to allow protections for clubs and equipment such as gloved, club head covers, and hats.

Figure 8:
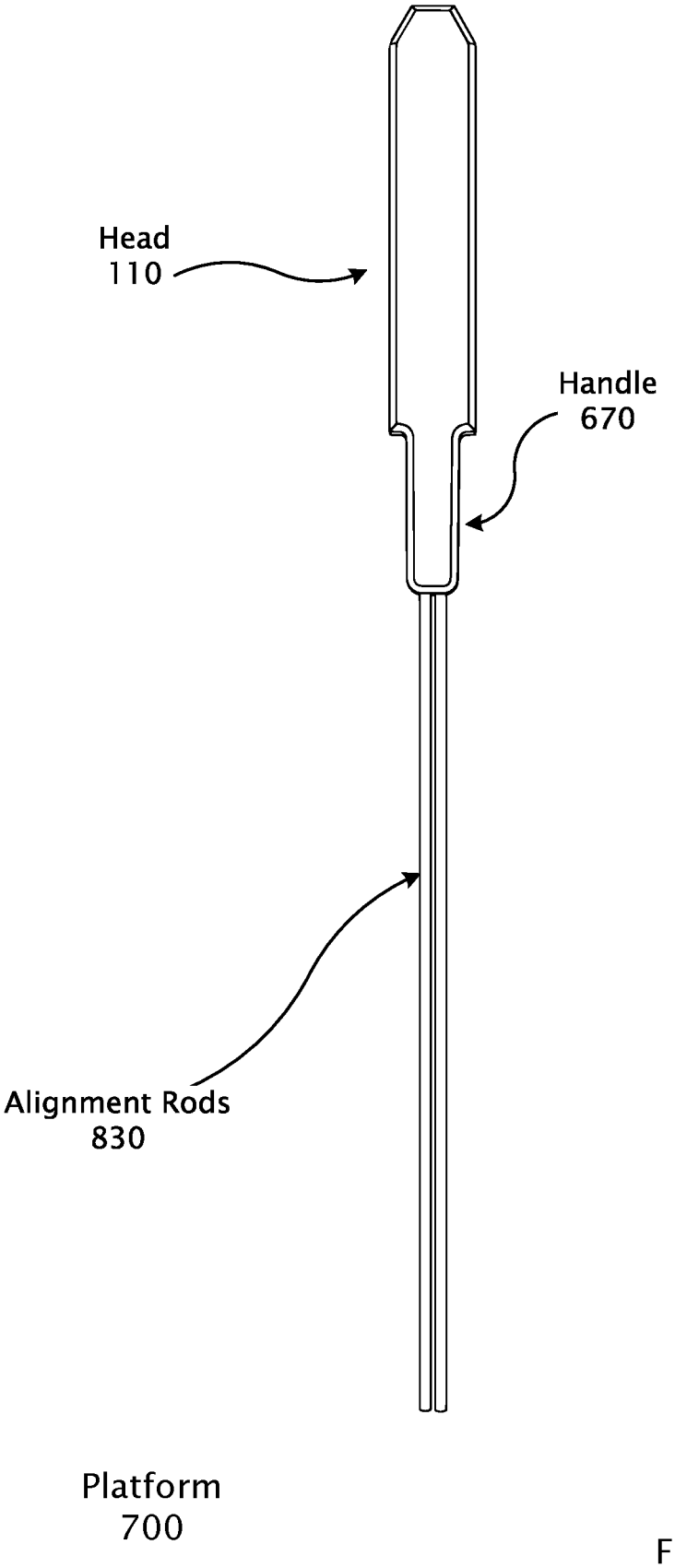
FIG. 8 is a diagram illustrating a platform, according to another implementation.

FIG. 8 is a diagram illustrating Platform 700 with Alignment Rods 830. Platform 700 may have Alignment Rods 830 stored in Handle 670 or in or below Head 110. Alignment rods may be alignment rods, alignment sticks, training sticks, or speed sticks. Alignment rods 830 may extend from Handle 670 to protect and separate alignment rods or sticks while within a golf bag.

Figure 9:
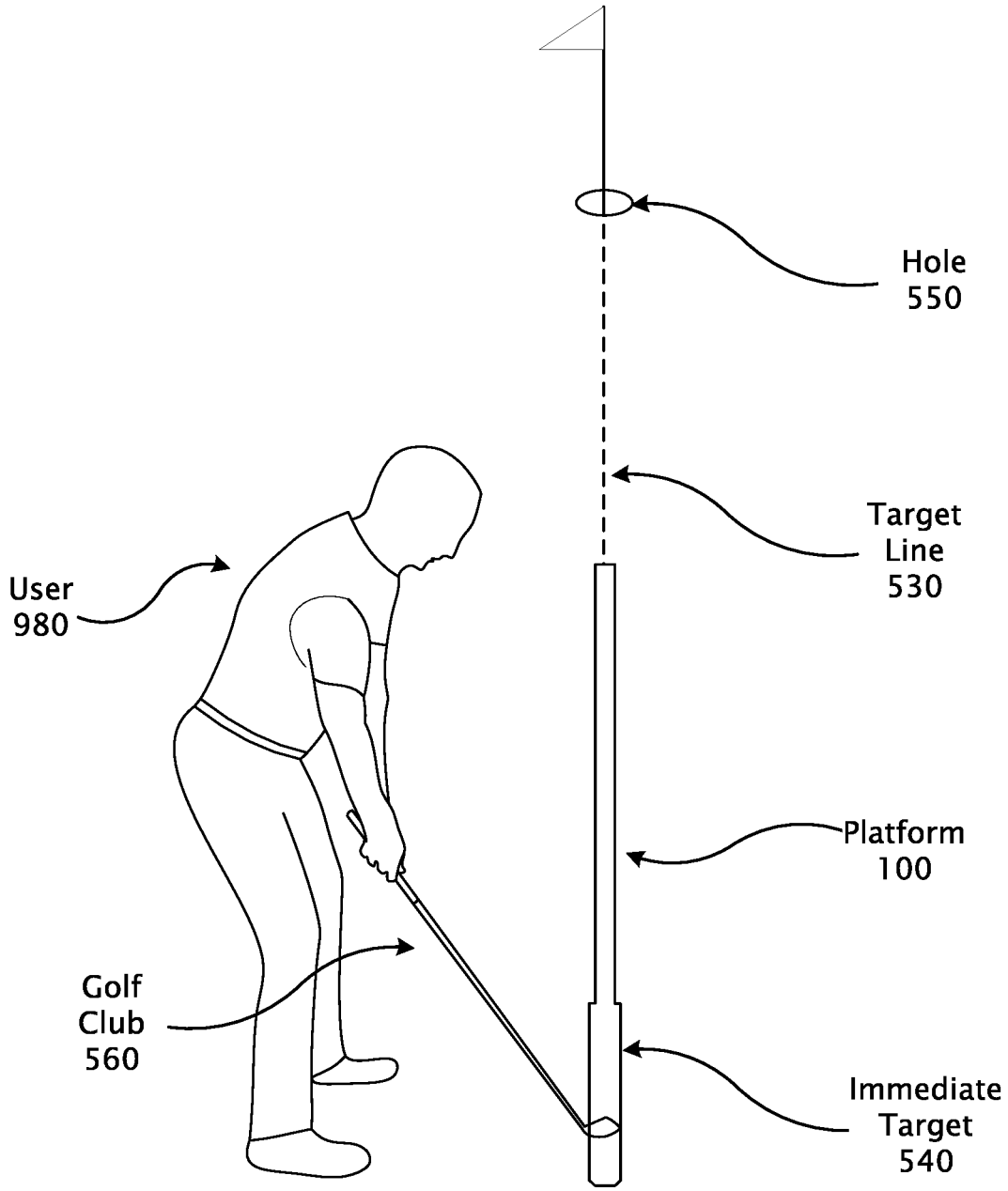
FIG. 9 is an illustration of a platform on a golf course, according to one implementation.

FIG. 9 is an illustration of Platform 100 on a golf course. User 980 may place Platform 100 on the ground, aligned with Target Line 530 toward Hole 550. User 980 may then stand near Platform 100 to help understand how they may improve their swing abilities by placing golf balls adjacent to or onto Platform 100 to get a ball line up properly and near or into the hole. User 980 may use Platform 100 as a parallel use alignment tool for putting or driving. User 980 may stand such that they may swing Golf Club 560 in line with Immediate Target 540 of Platform 100, which may assist in visualizing swing alignment and help User 980 improve a golf swing. Alternatively, User 980 may stand such that they are parallel with Immediate Target 540 of Platform 100, which also may assist in visualizing swing alignment and may help User 980 improve golf swing skills.

Figure 10:
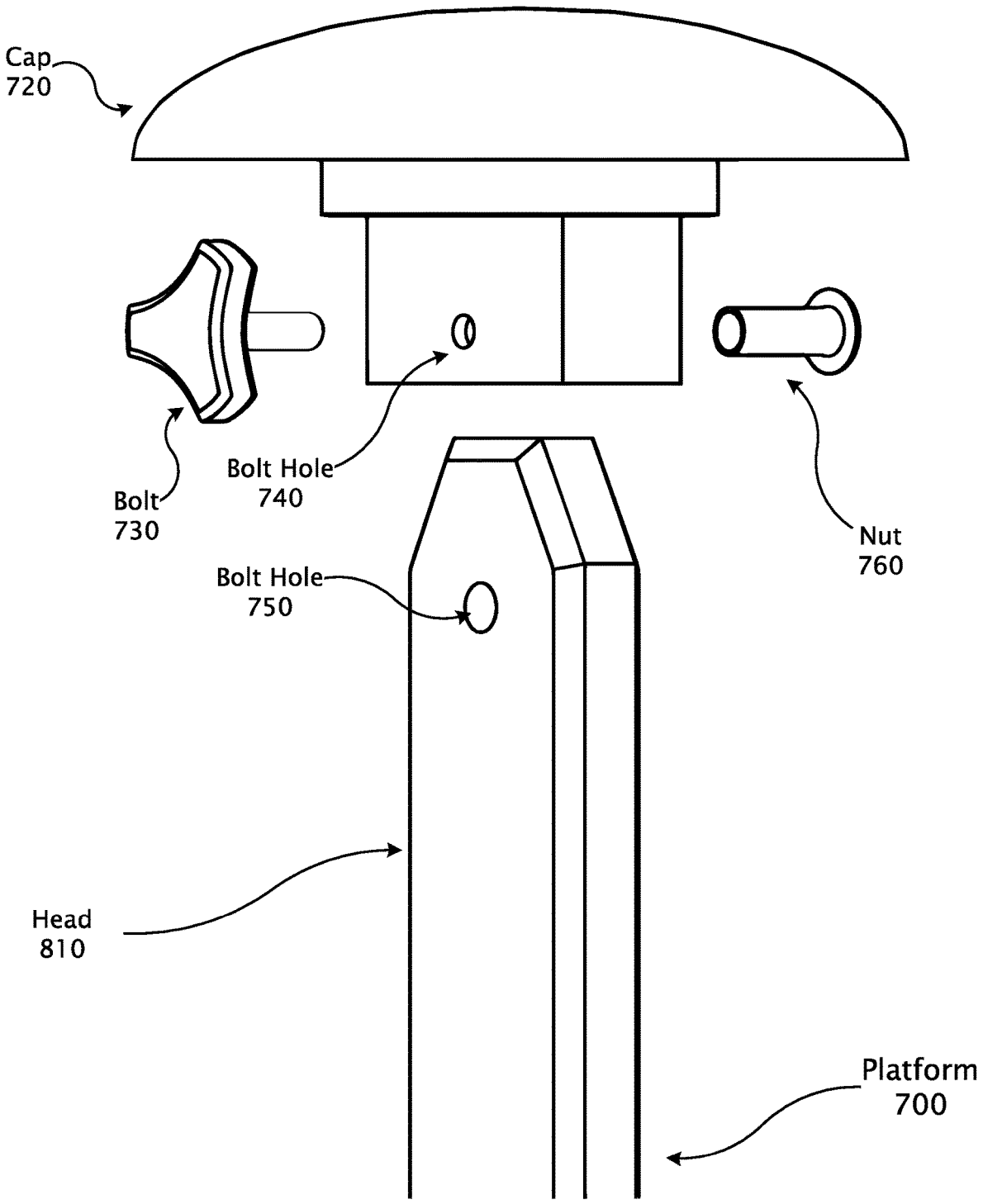
FIG. 10 is a diagram illustrating an exploded view of a protective cap and accessory connection device, according to one implementation.

FIG. 10 is an illustration showing how Cap 720 may be removably attached to Head 810. Cap 720 may attach to Head 810 by Nut 760 being placed through Bolt hole 740 of Cap 720 and Bolt Hole 750 of Head 810 and kept in place with Bolt 730.

Cap 720 may help safeguard golf equipment from becoming damaged and reduce travel bag wear or damage while golf equipment is being used with or without Inflatable Shield 910. Cap 720 may be sturdy and absorb energy placed on it from accidental top strikes, side impacts, and drops onto and over the top of Platform 100.

Figure 11:
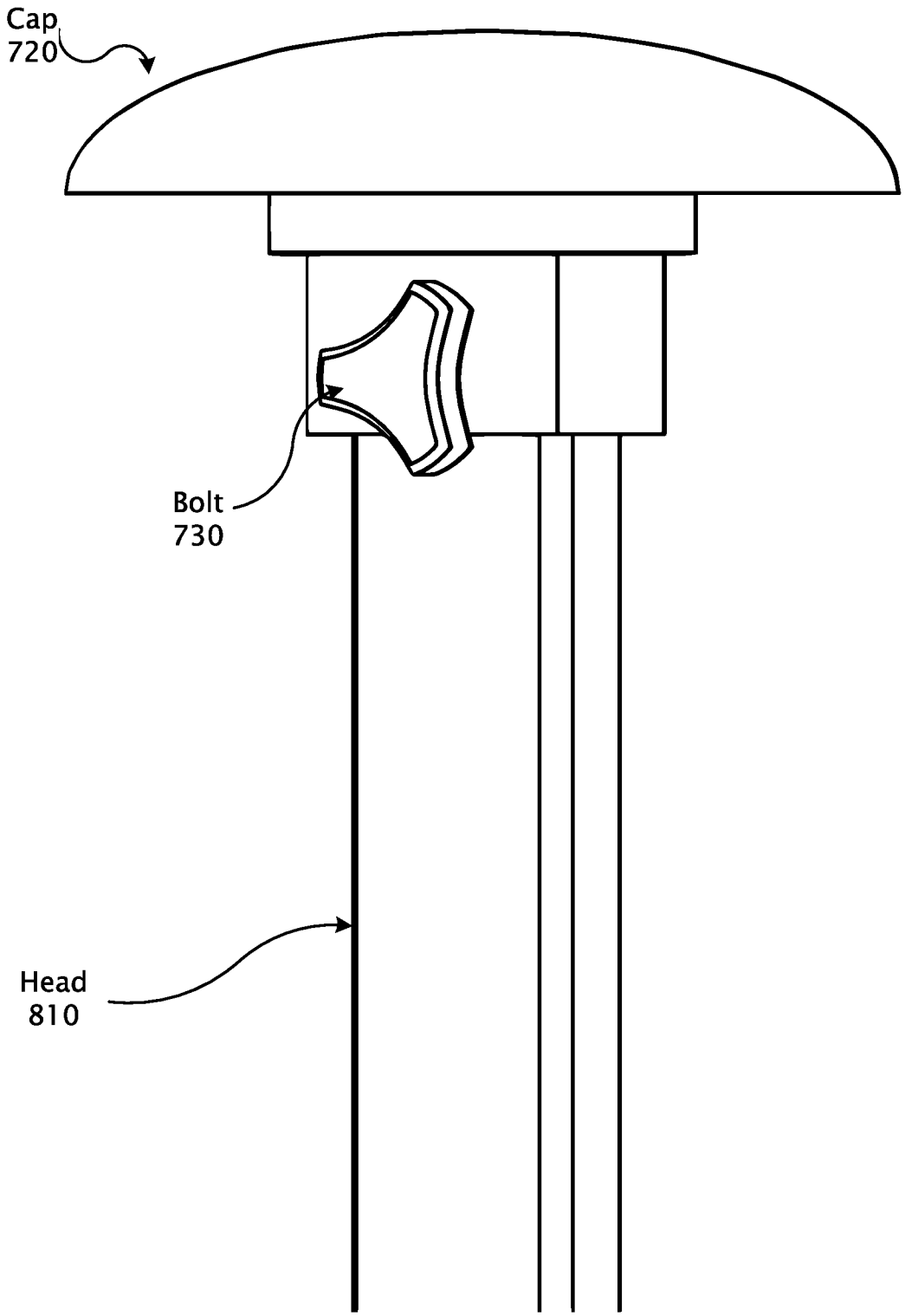
FIG. 11 is a diagram illustrating a protective cap, according to one implementation.

FIG. 11 illustrates Cap 720 disposed on Platform 700 with Head 810.

Figure 12:
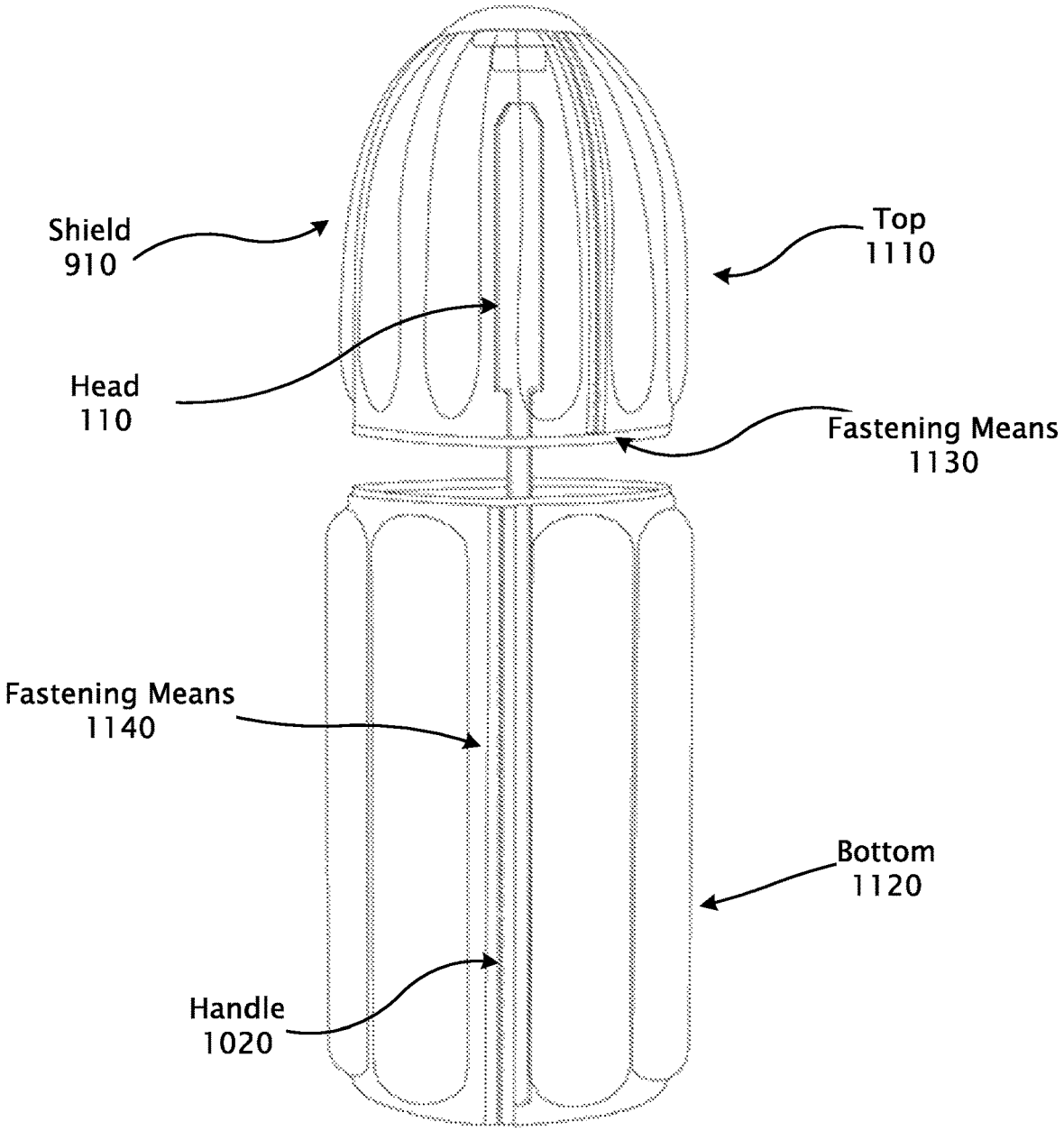
FIG. 12 is a diagram illustrating an inflatable protective shield, according to one implementation.

FIG. 12 illustrates Shield 910. Shield 910 may have two inflatable sections, Top 1110 and Bottom 1120, either of which may be used separately, or both may be used connected together. Top 1110 and Bottom 1120 may be fastened together with hook and loop fasteners, for example, or some other means, or they may be left as separate components. Top 1110 may have Fastening Means 1130 to allow easier installation and removal from a golf bag. For example, fastening Means 1130 and 1140 may be a zipper, hook and loop fasteners, snaps, or other means to open and close. Similarly, Bottom 1120 may have Fastening Means 1140 to allow easier installation and removal from a golf bag.

External impacts around a golf bag protected by Shield 910 may be passively absorbed and distributed within the inflatable system. Shield 910 may distribute shockwave forces evenly throughout the inflatable system, reducing impacts against any particular club or other areas contained within the golf bag. Shield 910 may form a semi-ridged energy absorbing device that protects golf clubs while in transit.

Shield 910 may allow a user to adjust inflation pressures to transform its shape to accommodate and fit snugly or loosely inside any manufacturer's golf travel bag. Shield 910 may fill the unsecured, unused, or vacuous areas within the golf bag with flexible inflatable channels of tubes. Once Shield 910 has been set, each inflatable chamber around the protected golf equipment may fill these spaces with changing air pressures as forces vary. Shield 910 may restore differential pressures by balancing a diameter and pressure level in response to the shifting load movements that may surround the golf bag.

Platforms 100, 200, 500, or 700 may be used as an independent device to provide protection, may be used with Cap 720, or may be used with Shield 910, which may give maximum protection. Shield 910 may be offered in multiple sizes, for example, one for tour bags and one for cart bags or stand bags.

Shield 910 may have a fastening system to secure it to Platform 100 and may be quickly and easily removed. Shield 910 may be inflatable, filling available space tightly. Shield 910 may be made of a foam or other material that may hold clubs to prevent them from hitting each other or may prevent external hits from damaging items in the golf bag.

Shield 910 may be sized to removably fit over Head 110, providing extra protection for clubs if a golf bag is dropped or something is dropped on the bag. It may help limit movement of clubs in a bag. A user may select various diameters as appropriate for their bag and clubs. Shield 910 may be made of a non-marring material, for example, plastic, and may be strong enough not to get damaged by the clubs in the bag. Shield 910 may not increase luggage weight or add baggage fees while protecting the golf equipment since it is inflatable, and the material may not weigh much.

Shield 910 may also act as an umbrella, protecting contents of a golf bag from weather elements.

Figure 13:
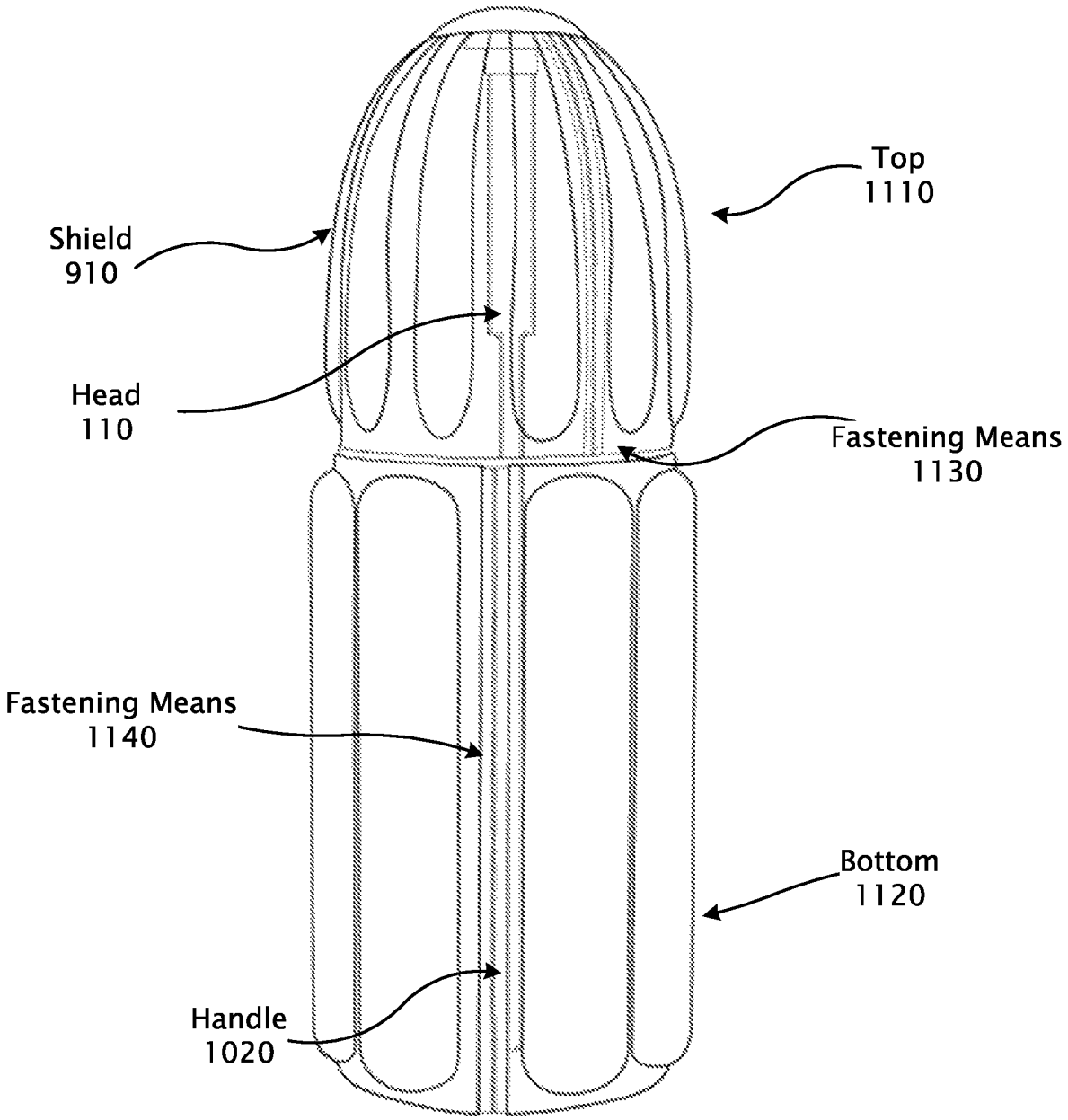
FIG. 13 is a diagram illustrating an inflatable protective shield, according to one implementation.

FIG. 13 illustrates Shield 910 with Top 1110 and Bottom 1120 fastened together.

Figure 14:
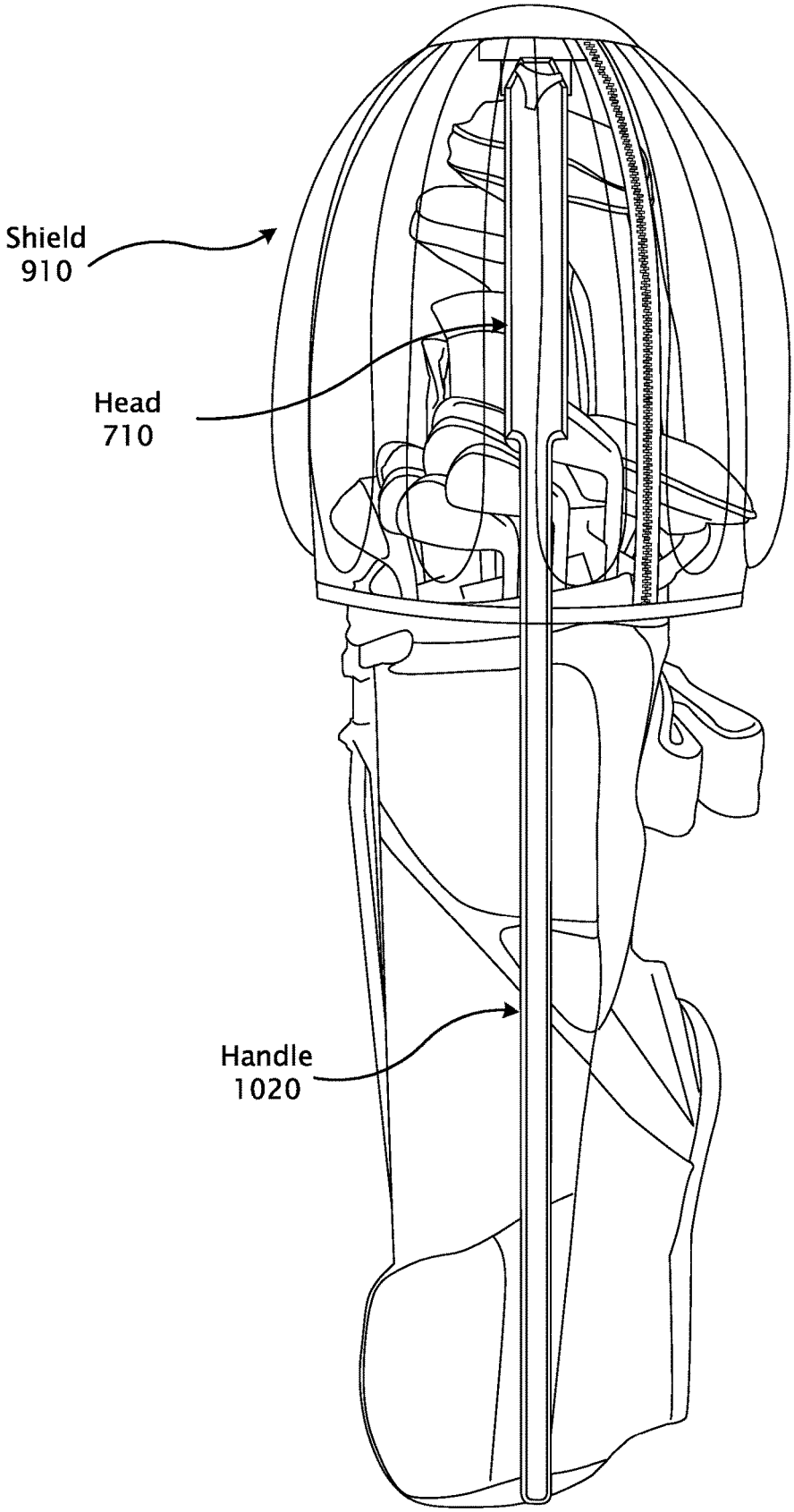
FIG. 14 is a diagram illustrating an inflated protective shield in use, according to one implementation.

FIG. 14 is a diagram illustrating Shield 910 as it may be used. Handle 1020 is shown, although it may not be visible inside the bag when in use. Shield 910 may help golf clubs and equipment arrive safely and undamaged to a destination while transported separately or while inside a golf travel bag. It may also double as a ridged inflatable umbrella that may shield golf equipment from all weather conditions and may allow golfers to use contemporary or standard umbrellas to shield themselves rather than their clubs.

Shield 910 may be a space-saving inflatable umbrella that may protect golf equipment from all weather conditions better and more secure than any golf umbrella or rain cover. Shield 910 may offer adjustability of apertures for quick-and-easy golf club access while keeping golf equipment safe and dry from heavy rain downpours or heavy driving weather. Shield 910 may be fastened to Cap 720, which may prevent it from flying off a golf bag in high winds.

Figure 15:
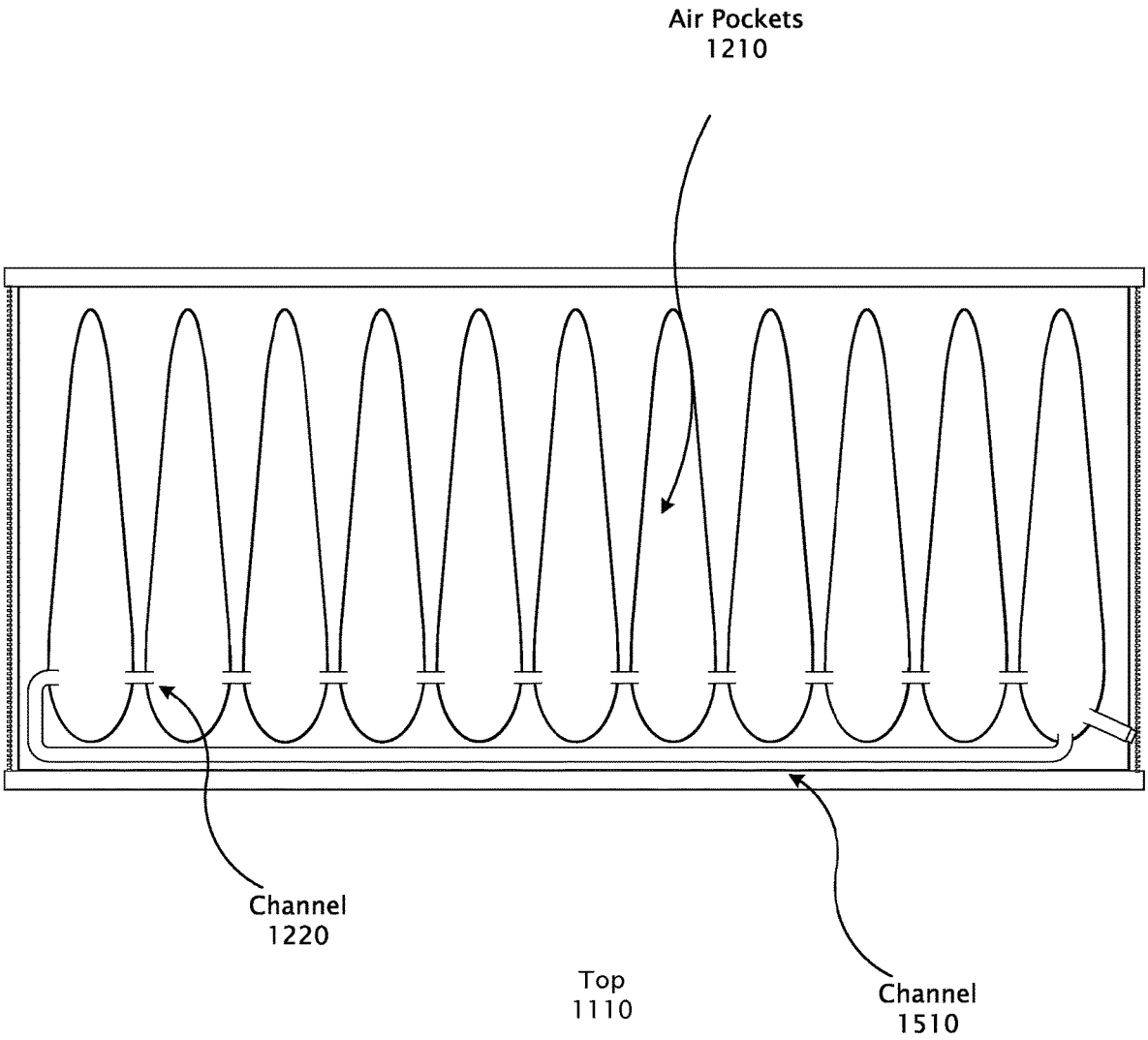
FIG. 15 is a diagram illustrating a structure of a top section of an inflatable shield, according to one implementation.

FIG. 15 illustrates air chambers in Top 1110 if Top 1110 were laid flat, according to one embodiment. Having Air Pockets 1210 connected via Channels 1220 and Channel 1510 may allow for easy inflation and force distribution between two or more bypass chambers securing equalized pressures of force between Air Pockets 1210 when Shield 910 is impacted.

Figure 16:
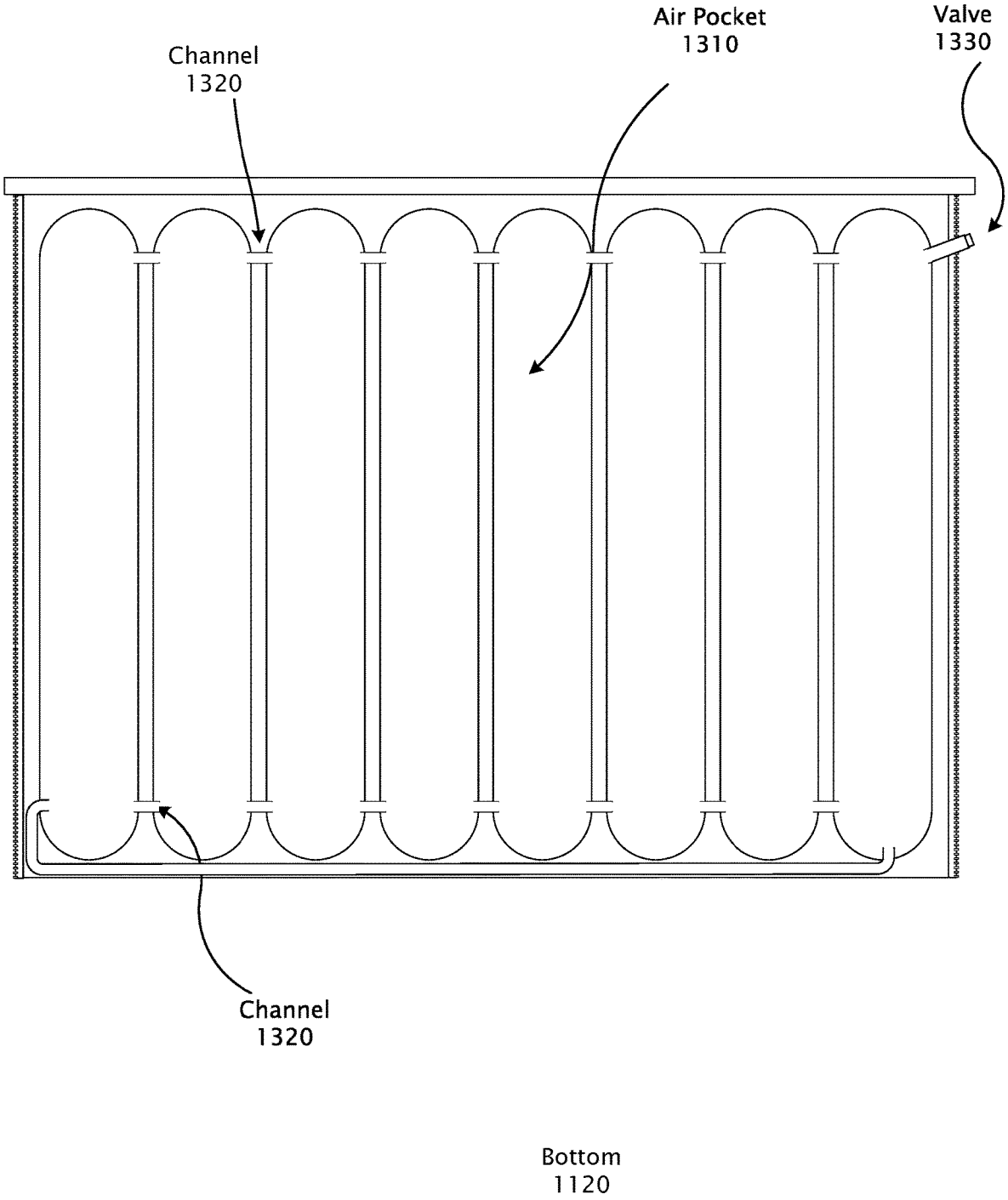
FIG. 16 is a diagram illustrating a structure of a bottom section of an inflatable shield, according to one implementation.

FIG. 16 illustrates air chambers in Bottom 1120 if Bottom 1120 were laid flat, according to one embodiment. Having Air Pockets 1210 connected via Channels 1220 allows easy inflation and distribution between Air Pockets 1210 when Shield 910 is impacted. Having two Channels 1320 on each Air Pockets 1310 may reduce the likelihood of An Air Pocket 1310 being cut off by a Channel 1320 being pinched and assuring equalized pressure-flow between chambers from unforeseen blockages.

Valve 1330 may allow Bottom 1120 to be inflated. Valve 1330 may be used to manually blow up Bottom 1120 using breath or may be attached to a source of compressed air, or other gas.

Figure 17:
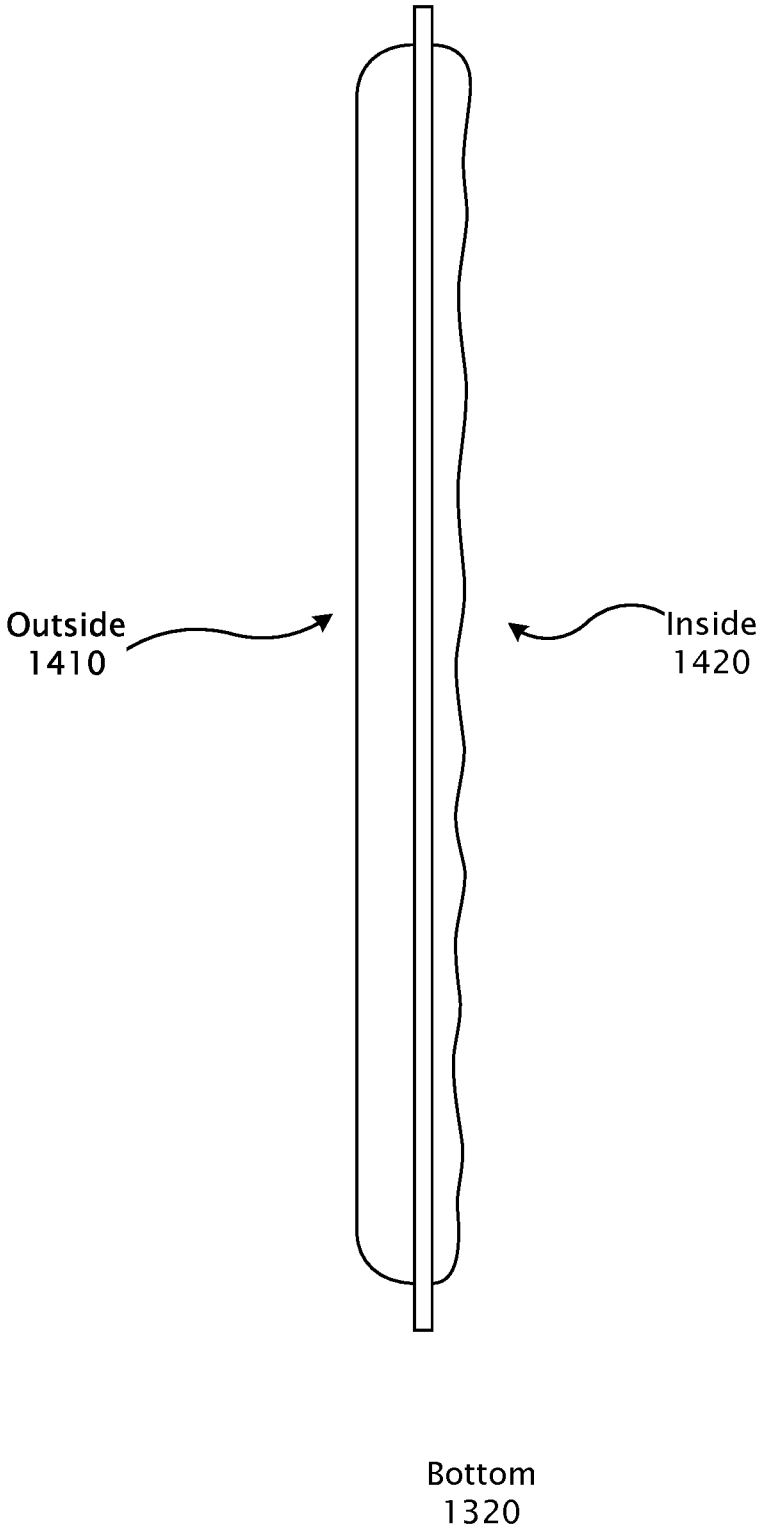
FIG. 17 is a diagram illustrating a side cutaway view of an inflatable shield, according to one implementation.

FIG. 17 is a cross-sectional side view of Bottom 1120 and top 1110. Inside 1420 may inflate toward golf equipment in a bag, for example, while Outside 1410 may inflate toward a golf bag, for example, to provide extra protection against impacts by dispersing energy equally throughout the platform with optional or preferred separate inflation levels on each side of the core.

Figure 18:
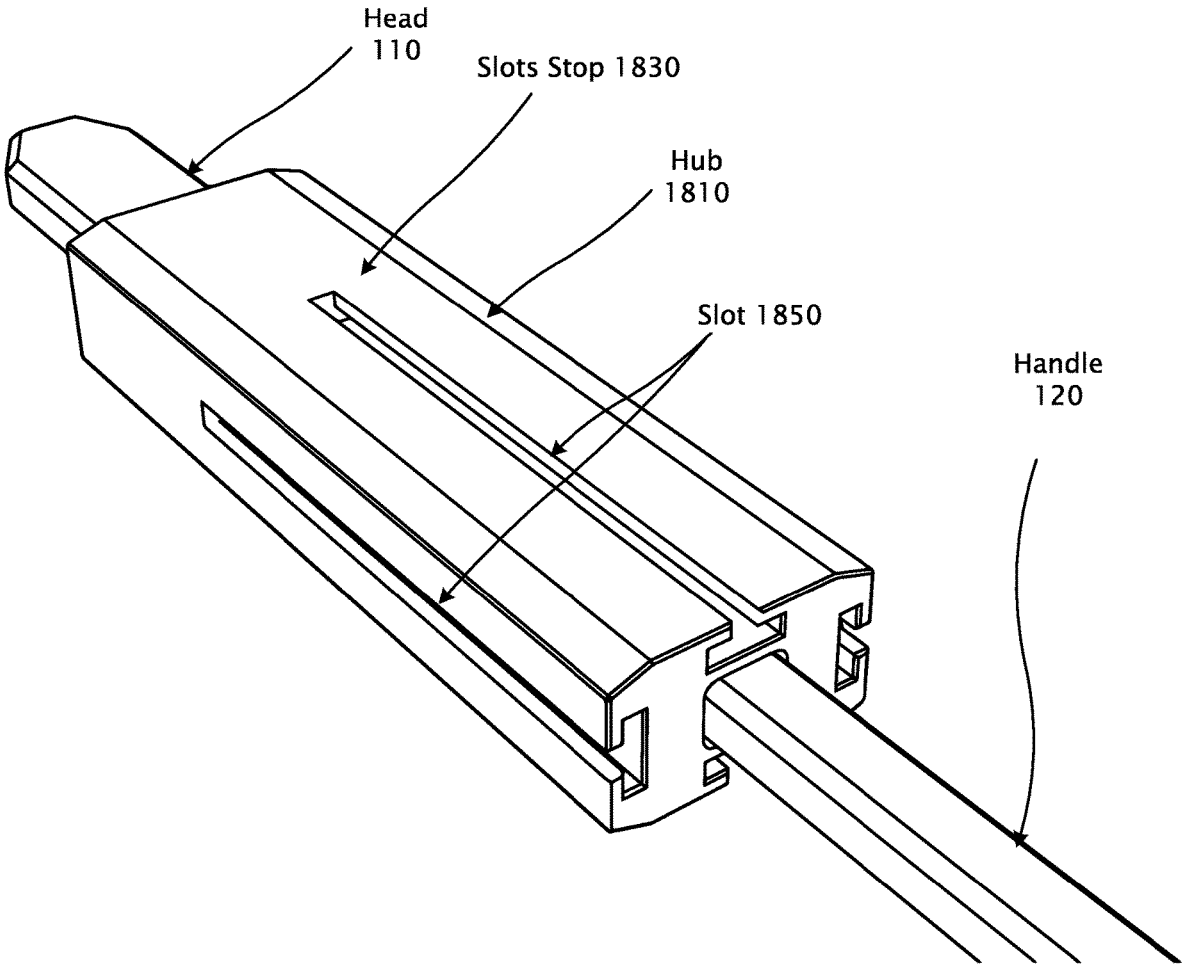
FIG. 18 is a diagram illustrating a hub, according to one implementation.

FIG. 18 shows Hub 1810. Hub 1810 may provide a simple, sturdy way to snap in or slide off attachable aerodynamic quadrants for interchangeable preferences within a single training device. It may be configured to support a speed training tool and wind resistance device, for example, a speed wing, Cap 720, an x-wing, aerodynamic cover plates, and various sized slide on, slide off rail position weights for user custom controllability. Adding or repositioning various sized weights may significantly increase loading levels for an "action to reaction" golf swing around all four rail positions. Changing wing configurations and adjusting weights onto preferred rail locations may allow a user to have effective training tools for whatever goals the user may have.

Hub 1810 may slide over Platform 100 to provide a secure coupling between Platform 100 and other attachments. Hub 1810 may slide over Platform 100 from over Handle 120, with Slots Stop 1830 to catch a flange on the head of Platform 100. Walls on sides of Hub 1810 may form Slots 1850, which may provide a secure fastening system for accessories to removably attach to Hub 1810. Hub 1810 may also have a snug fit over Platform 100, which may provide friction to assist in securing Hub 1810 to Platform 100.

Figure 19:
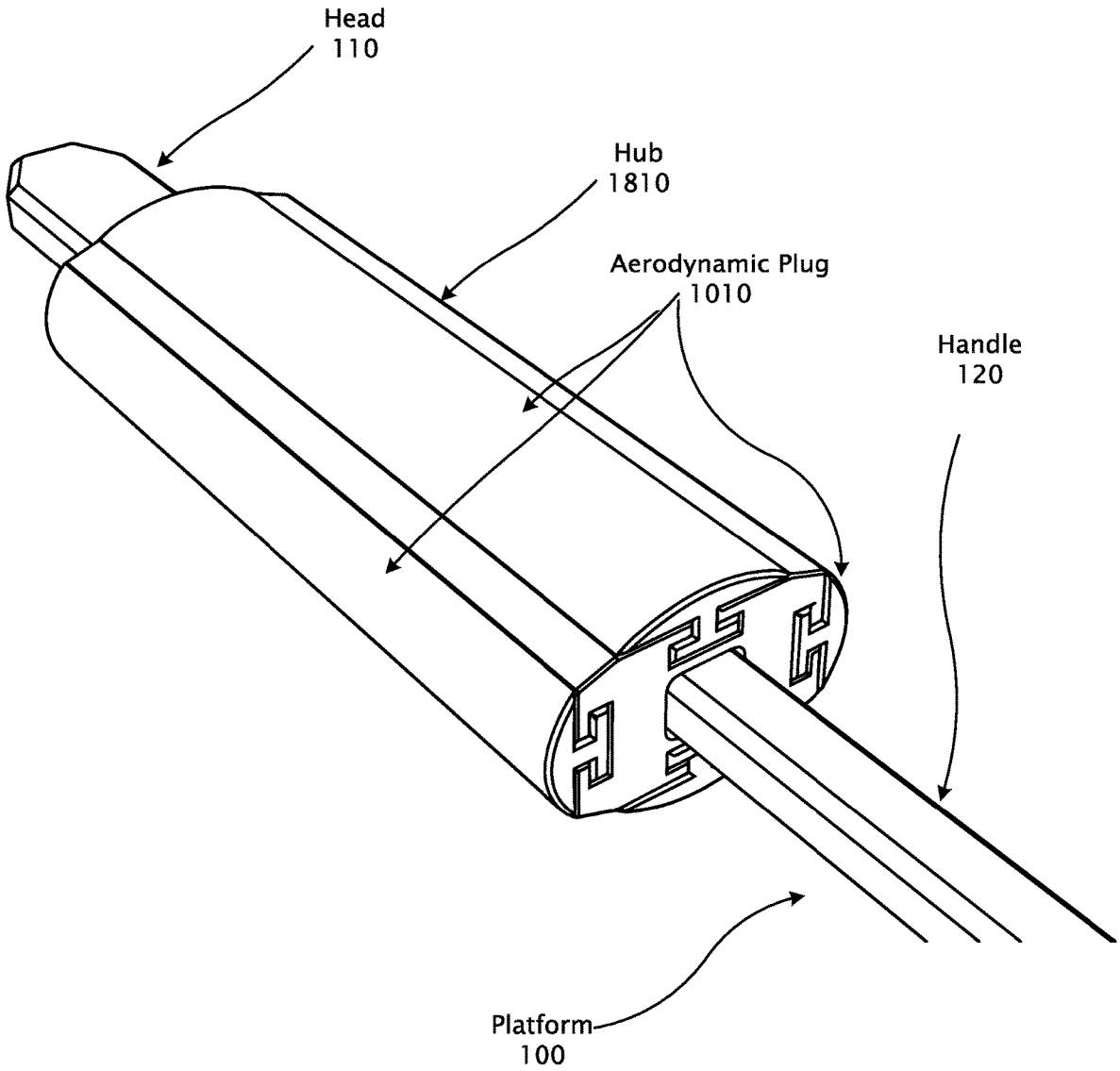
FIG. 19 is a diagram illustrating a hub with plugs covering unused slots, according to one implementation.

FIG. 19 shows Hub 1810 with Plugs 1010 covering Slots 1850 when one or more Slots 1850 may not be used for an accessory. Plugs 1010 may slide into one or more Slots 1850 until reaching Slots Stop 1830. Centrifugal force may hold Plugs 1010 in place when swinging Platform 100. Other fastening means, for example, friction, snaps, screws, hook and loop fasteners, or other fasteners, may be used to hold Hub 1810 on Platform 100.

Figure 20:
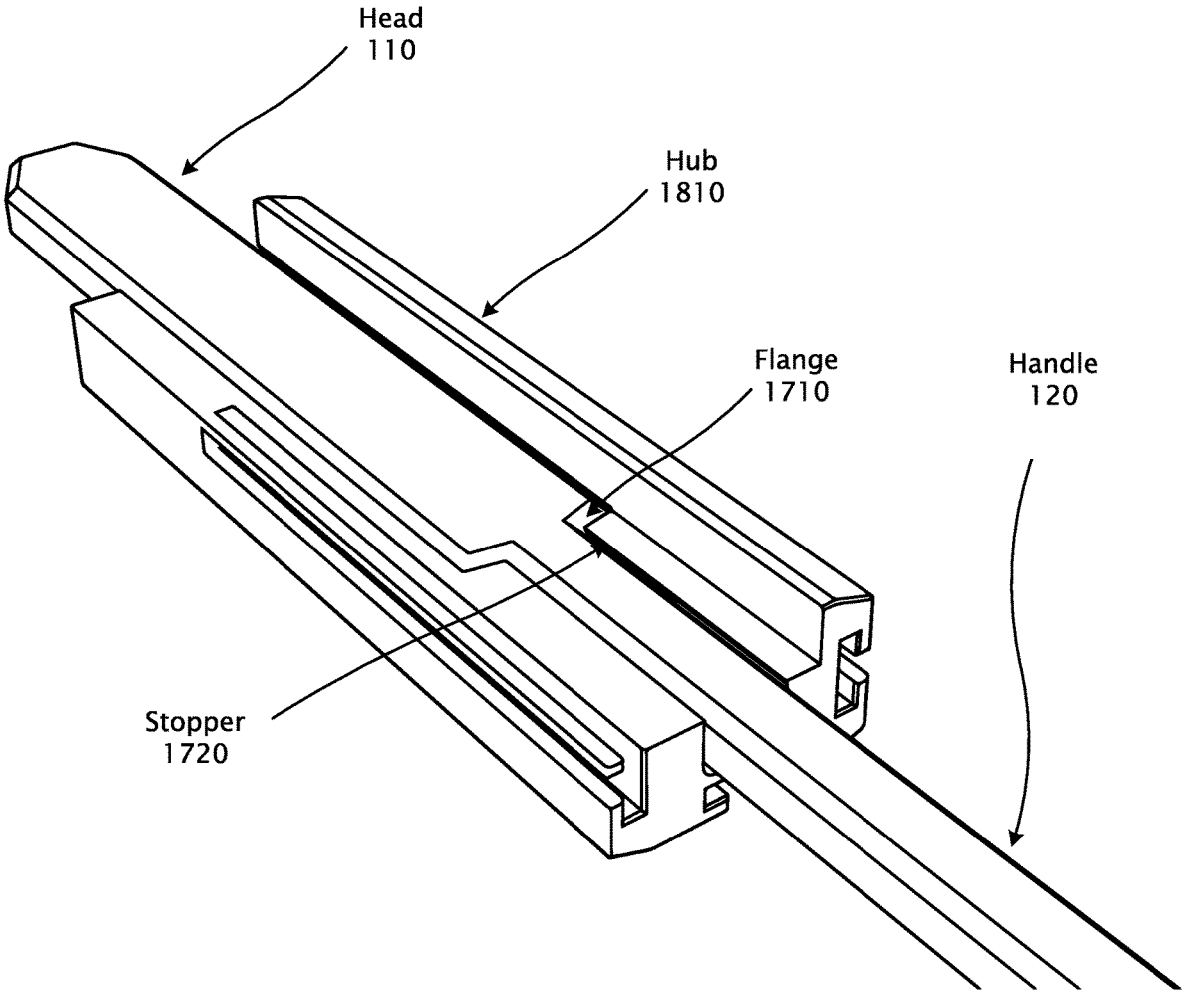
FIG. 20 is a diagram illustrating a cutaway view of a hub, according to one implementation.

FIG. 20 shows a cutaway view of Hub 1810. Flange 1710 may be a part of Platform 100. Stopper 1720 may prevent Hub 1810 from sliding past Flange 1710 toward Head 110 of Platform 100.

Figure 21:
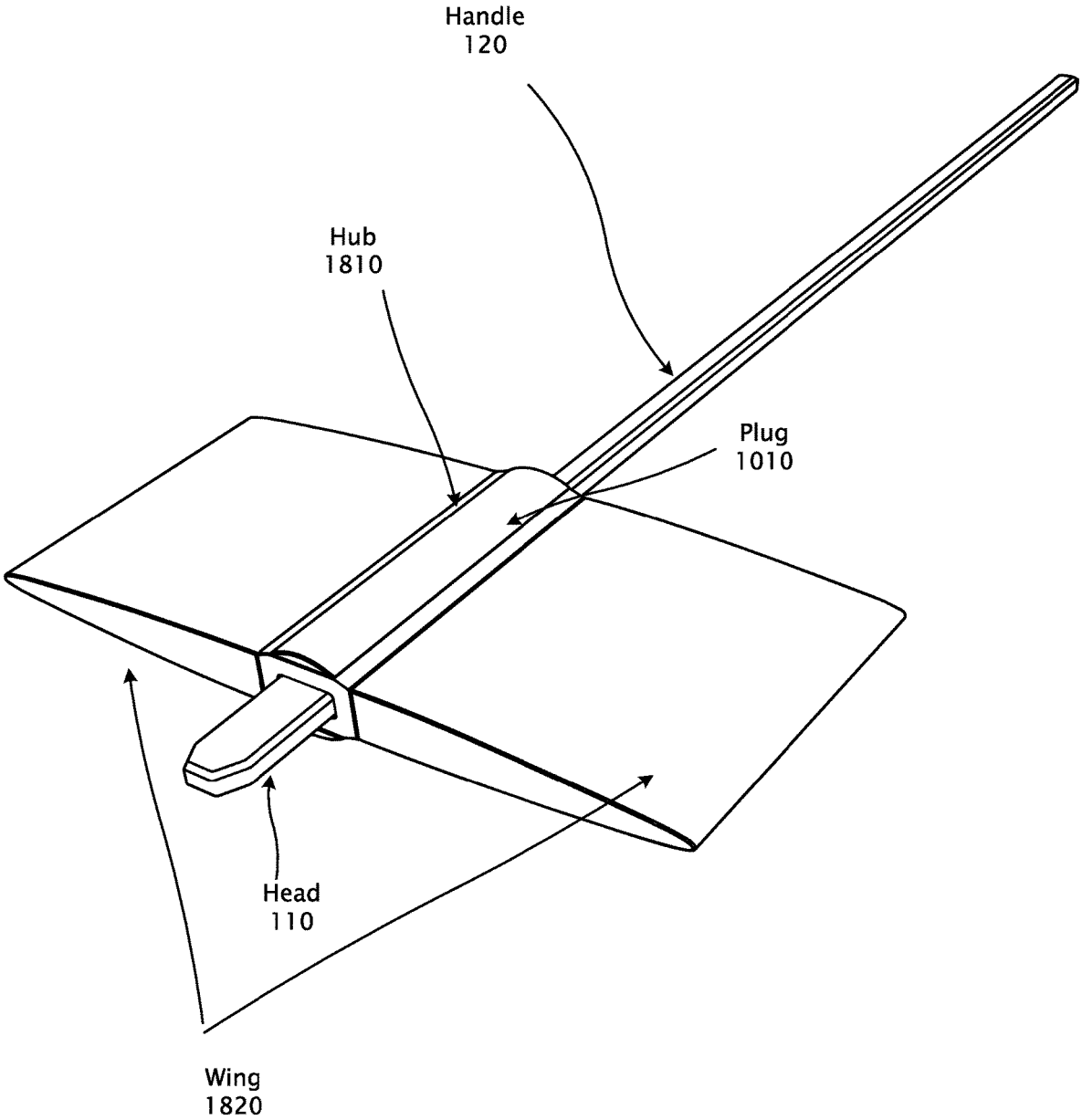
FIG. 21 shows two wings attached to a hub, according to one implementation.

FIG. 21 shows two Wings 1820 attached to Hub 1810. A configuration with one or two Wings 1820 may be known as a speed wing, which may provide a user with segment sensing within various attitude positions throughout a swing arc, and may offer a user a simple, effective, and balanced speed golf swing training tool.

Wings 1820 may increase muscle development and support faster muscle memory training effects. Cambered airfoils on each surface of Wings 1820 may increase drag coefficients in various attitudes during a swing arc. Wings 1820 may removably lock to Hub 1810.

Wings 1820 may be airfoils. Leading and trailing edges may be aerodynamically similar in design, which may provide consistent swing speed testing in either swing direction, forwards, or backward. In another implementation, Wings 1820 may be flat or may have other shapes to provide various types of resistance.

Wings 1820 may provide instant feedback of side-spin movement throughout a swing arc, which may assist a user to improve a swing by delivering proper swing angles for efficient ball flight and back-spin. It may help train users to swing faster while maintaining full follow-through and extension control in achieving better golf swing dynamics.

Wings 1820 may also provide a perpendicular ram-air resistance position to warm up a golfer's muscles before going out and playing.

Various low-level angles for ultra-fast swing training with stabilized "rotational inertia" may also improve a user's confidence in a swing. A swing pole or rod with a weight attached to an end may not create any sense of stability because it may not have a flange or a wing. Speed Wing 1820 may stabilize a moment of inertia within an arc, allowing a user to feel the correct angles for an ideal moment of rotational inertia efficiencies.

Various configurations may be used, one with no wing, one with one wing for in-line speed training, or one with two-winged for speed training.

Hub 1810 may support one, two, three, or four Wings 1820, to assist in training various aspects of a golf swing.

Figure 22:
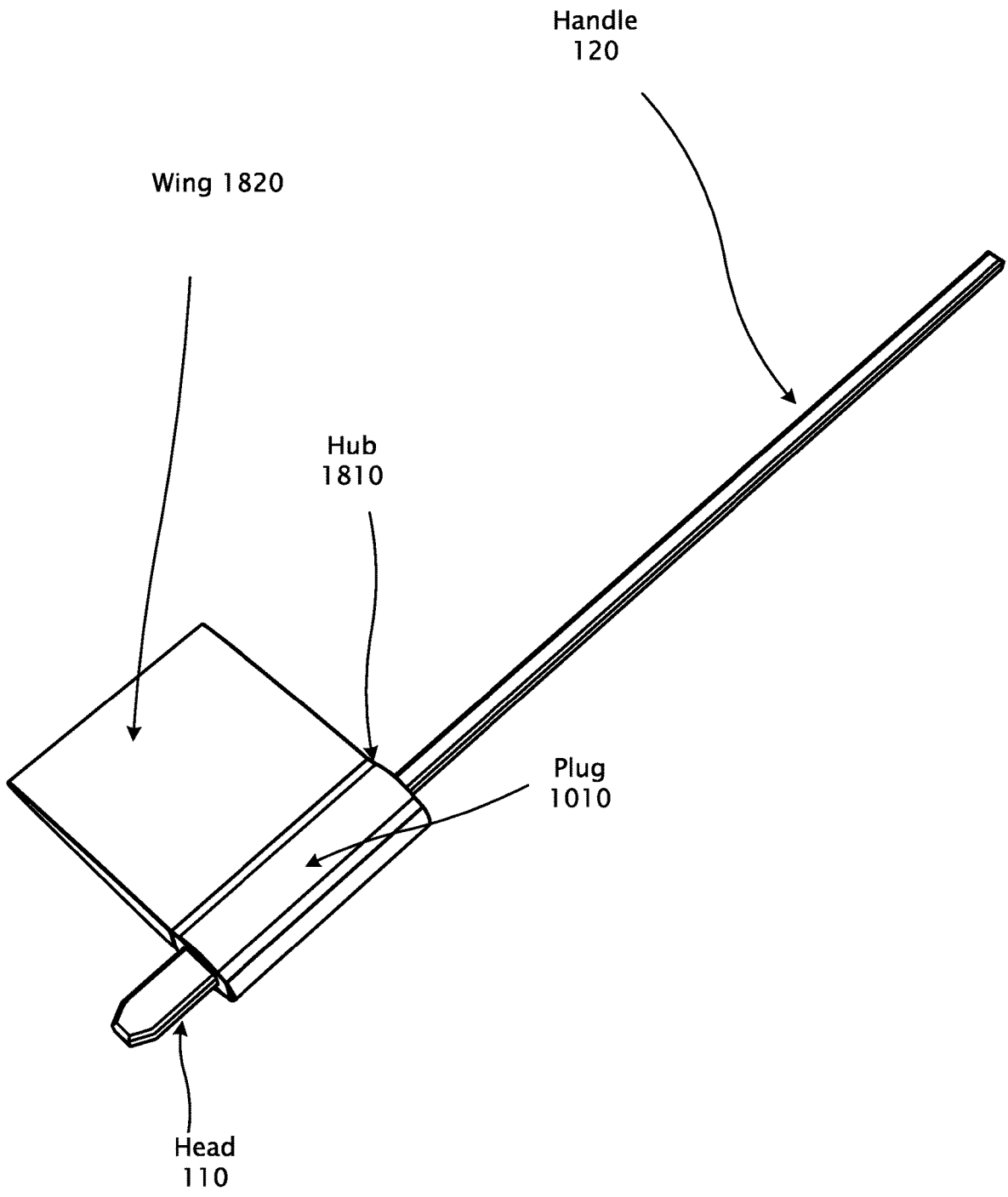
FIG. 22 shows one wing attached to a hub, according to another implementation.

FIG. 22 shows one Wing 1820 attached to Hub 1810, according to one implementation. This configuration may be used for swing speed training.

Figure 23:
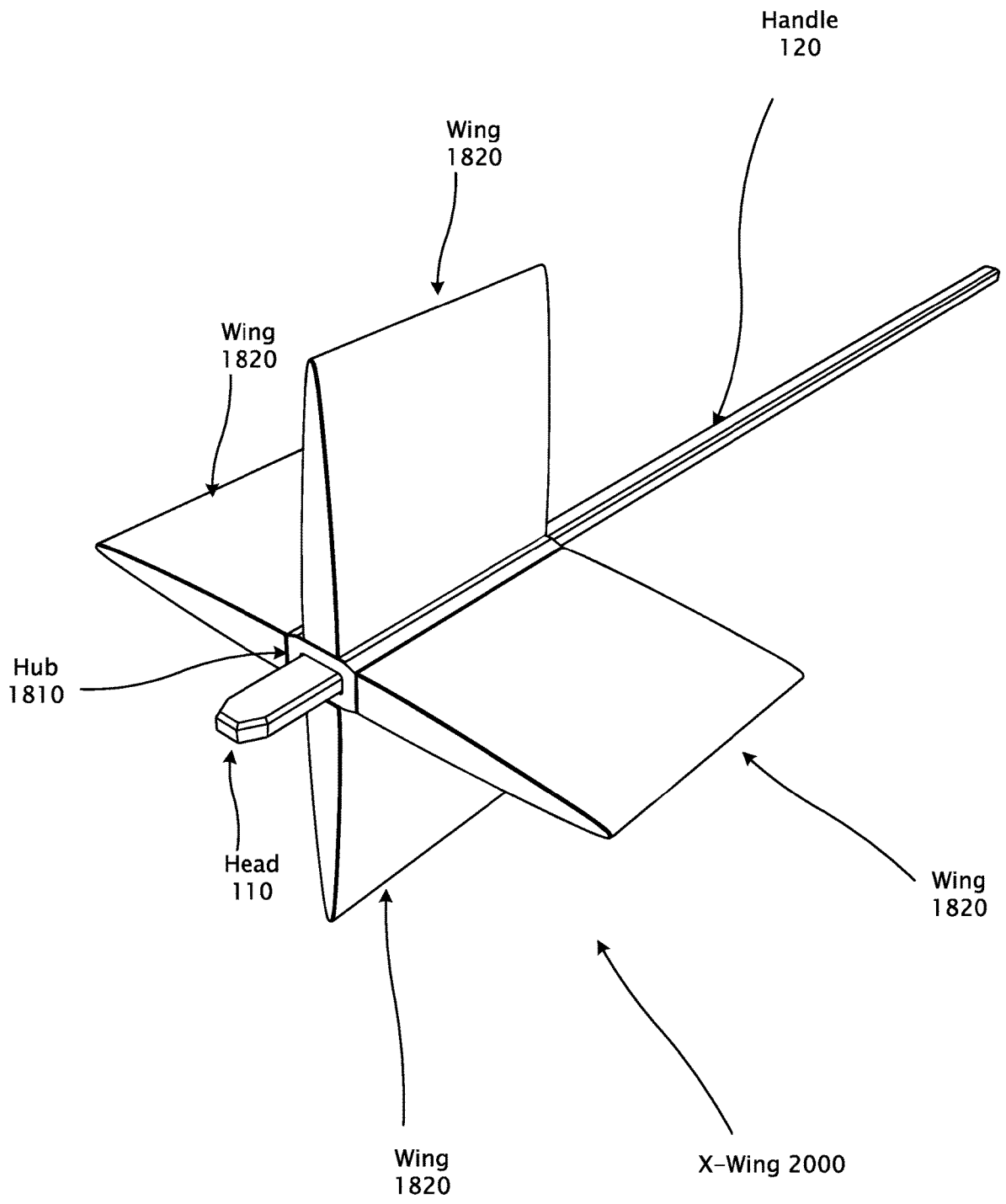
FIG. 23 shows four wings attached to a hub, according to one implementation.

FIG. 23 shows four Wings 1820 attached to Hub 1810, according to one implementation. This configuration may be known as an x-wing. An x-wing may provide aerodynamic resistance training for golf swings.

Resistance devices may be used to warm up muscles before playing golf. An x-wing changes wind friction angles favoring various aerodynamic resistance settings. A user may control the golf club arc speed by choking up or down on the base portion of Platform 100. If the grip location is further away from Head 110 of the Platform 100, the radius may be greater, and a swing speed may be faster, which may result in more sensitivity in alignment results. In contrast, the shorter the radius, the slower the swing speed, resulting in less sensitivity in alignment feedback.

An x-wing may offer a non-directional heavy disturbance resistance training device. A user may have complete control of the level of strenuous and stainable resistance training desired.

Figure 24:
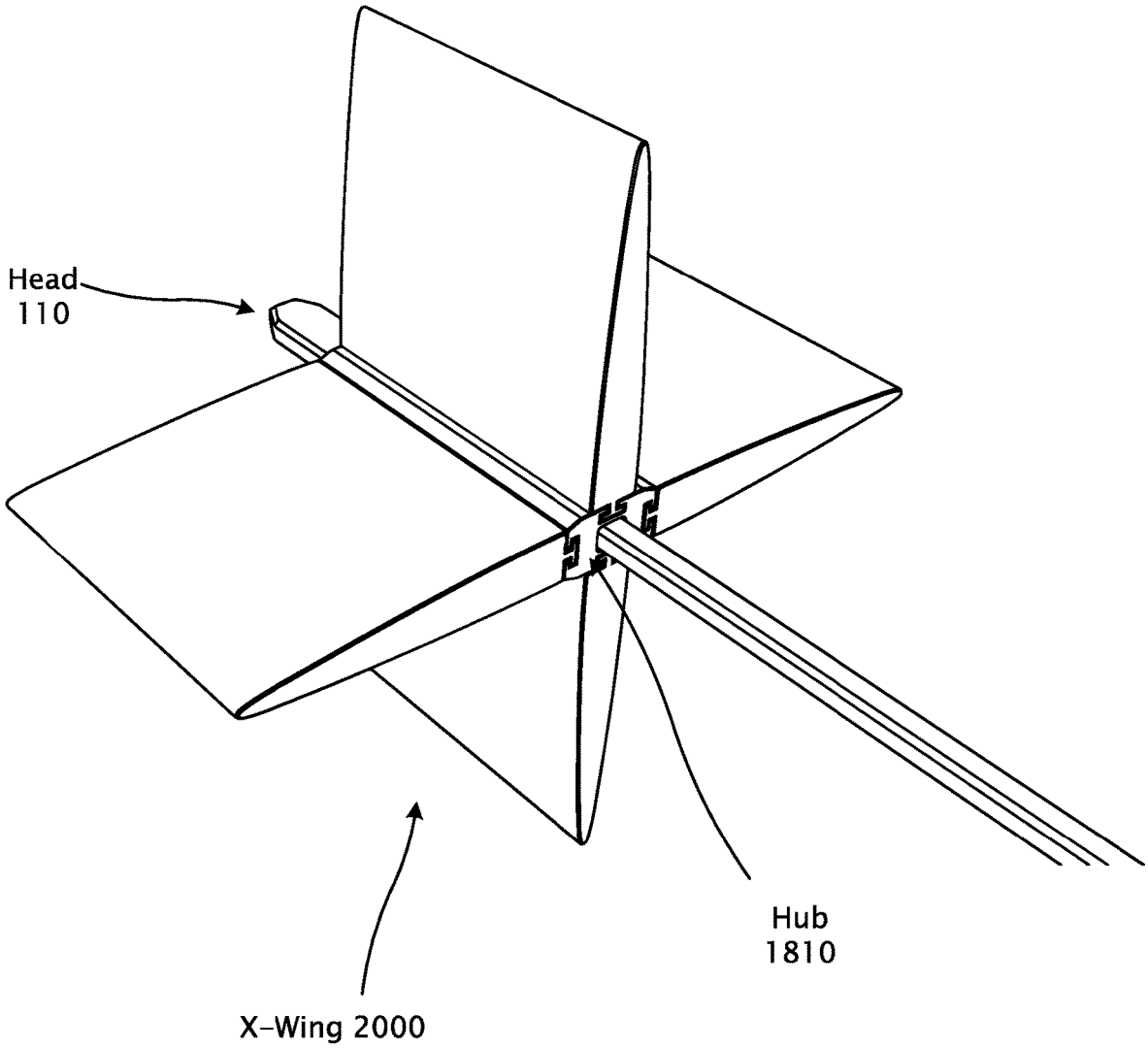
FIG. 24 shows a different view of four wings attached to a hub, according to one implementation.

FIG. 24 illustrates a bottom perspective view of X-Wing 2000.

Figure 25:
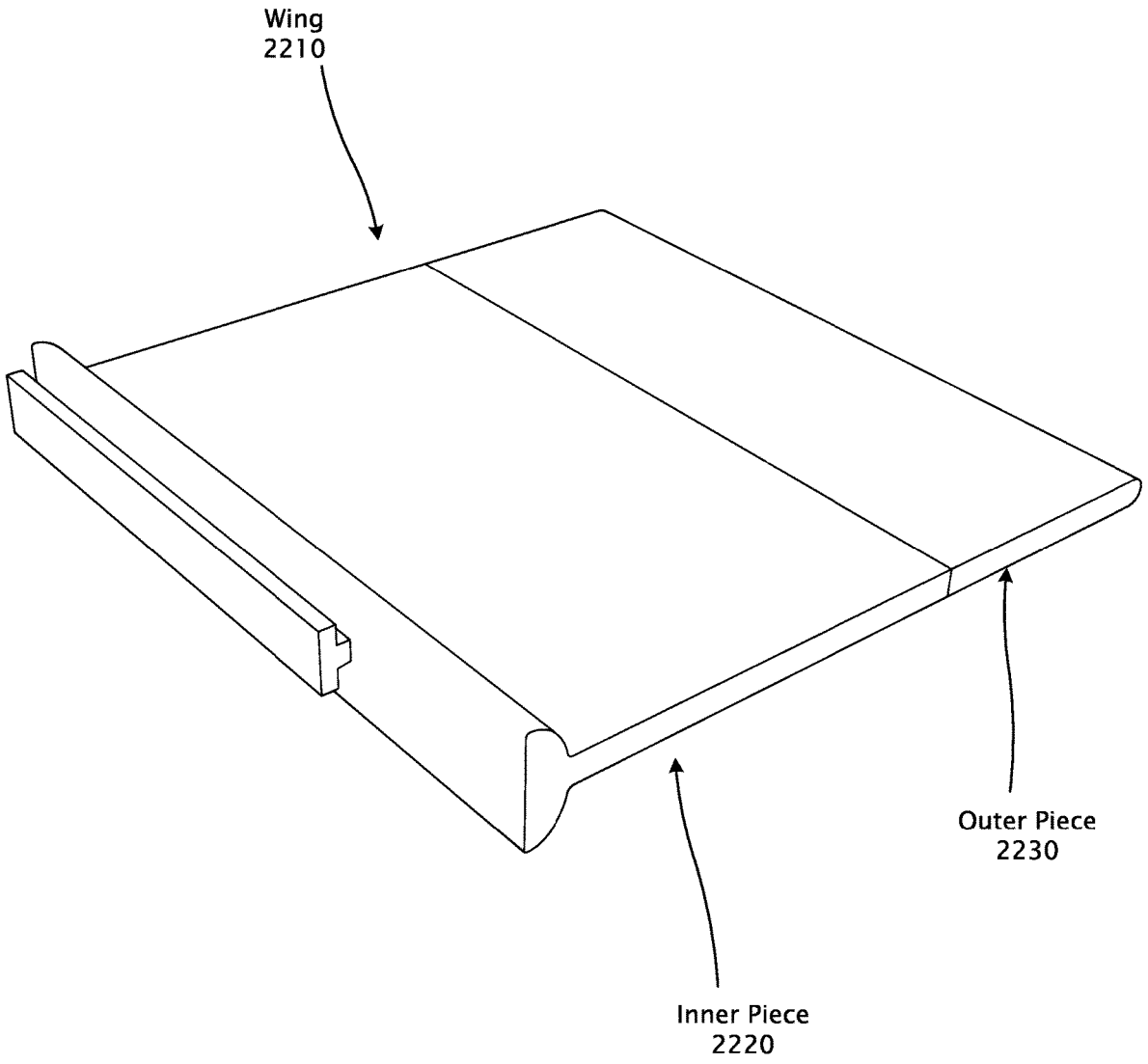
FIG. 25 illustrates a wing, according to one implementation.

FIG. 25 illustrates Wing 2210, according to one implementation. Wing 2210 may have Inner Piece 2220 and Outer Piece 2230. Wing 2210 may be used with just Inner Piece 2220 or with both Inner Piece 2220 and Outer Piece 2230 to allow an additional adjustment for selecting the type of swing practice desired. One, two, three, or four Wing 2210 may be attached to Hub 1810 in various configurations. One having skill in the art will recognize other configurations of wings may be used.

Figure 26:
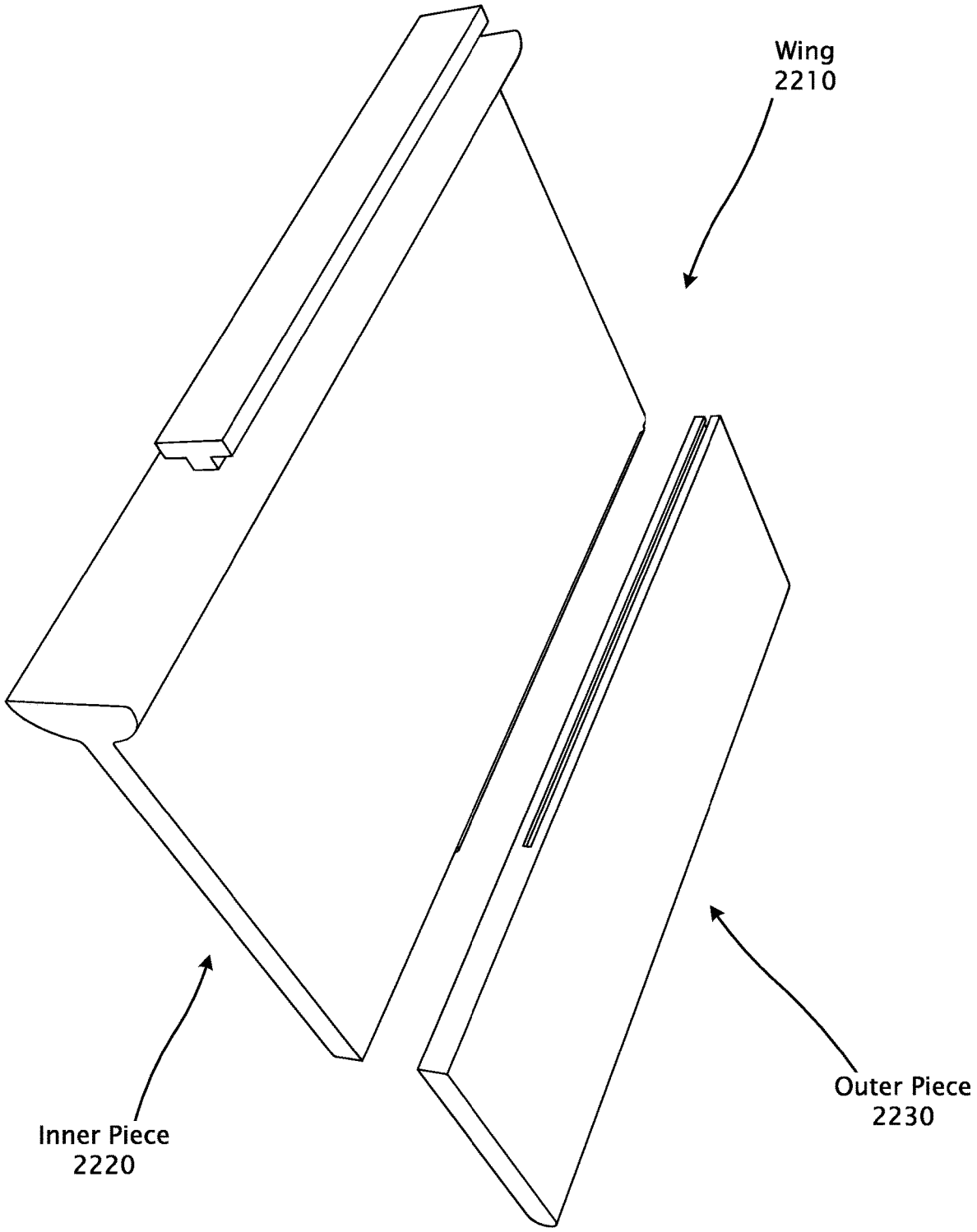
FIG. 26 illustrates a wing with an inner piece and outer piece separated, according to one implementation.

FIG. 26 illustrates Wing 2210 with Inner Piece 2220 and Outer Piece 2230 separated. Out Piece 2230 may slide onto Inner Piece 2220, and be held in place by centrifugal force, friction, or other fastening means, similar to Plugs 1010 described supra.

Wing 1820 or Wing 2210 may be made of injected ridged Styrofoam, plastic, or may be an inflatable device, for example. One having skill in the art will recognize that many different materials or combinations of materials may be used for Wing 1820 or Wing 2210.

While various aspects of implementations within the scope of the appended claims are described above, various features of implementations described above may be embodied in a wide variety of forms, and that any specific structure or function described above is merely illustrative. An aspect described herein may be implemented independently of any other aspects, and two or more of these aspects may be combined in various ways. For example, an accessory may be implemented, or a method may be practiced using any number of the aspects disclosed herein. In addition, such an accessory may be implemented, or such a method may be practiced using other structures or functionality in addition to or other than one or more of the aspects disclosed herein.

While the terms "first," "second," etc., may be used herein to describe various elements, these elements should not be limited by these terms. These terms are only used to distinguish one element from another.

The terminology used herein is for the purpose of describing particular implementations only and is not intended to limit the scope of the claims. As used in the description of the implementations and the appended claims, the singular forms "a," "an," and "the" are intended to include the plural forms unless the context clearly indicates otherwise. The terms "comprises" or "comprising," when used in this specification, specify the presence of stated features, integers, steps, operations, elements, or components, but do not preclude the presence or addition of one or more other features, integers, steps, operations, elements, components, or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

The invention claimed is:

1. A golf accessory platform, comprising:

a head, the head being between 1" and 5" wide, 11" to 15" tall, narrowing to between 1" and 2" at a top, and 0.5" to 2.5" thick; and a handle, the handle between 39" and 45" long, transitioning to the head with a flange, the flange between ½" and 1" tall and operable to prevent a hub from slipping past the head when slid over the handle; and a hub, comprising a slot operable to hold a first wing.

2. The golf accessory platform of claim 1, wherein the hub further comprises a slot operable to hold a second wing.

3. The golf accessory platform of claim 1, wherein the hub further comprises slots operable to hold a plurality of wings.

* * * * *